US006347865B1

(12) United States Patent
Matsumoto et al.

(10) Patent No.: US 6,347,865 B1
(45) Date of Patent: Feb. 19, 2002

(54) LIQUID CONTAINER, LIQUID SUPPLY SYSTEM, AND METHOD FOR MANUFACTURING SUCH LIQUID CONTAINER

(75) Inventors: Hidehisa Matsumoto, Kawasaki; Shozo Hattori, Tokyo; Hajime Yamamoto, Yokohama; Eiichiro Shimizu, Yokohama; Jun Hinami, Yokohama; Hiroki Hayashi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/558,658

(22) Filed: Apr. 26, 2000

(30) Foreign Application Priority Data

Apr. 27, 1999 (JP) ..... 11-120616

(51) Int. Cl.[7] ..... B41J 2/175
(52) U.S. Cl. ..... 347/86
(58) Field of Search ..... 347/85, 86, 87; 220/495, 666

(56) References Cited

U.S. PATENT DOCUMENTS 5,975,330 A 11/1999 Okada ..... 220/495.1
6,012,807 A * 1/2000 Olsen et al. ..... 347/85
6,022,102 A * 2/2000 Ikkatai et al. ..... 347/85

FOREIGN PATENT DOCUMENTS

| | | | |
|---|---|---|---|
| EP | 439078 | 7/1991 | |
| EP | 581531 | 2/1994 | |
| EP | 07068776 | * 3/1995 | ..... B41J/2/175 |
| EP | 678390 | 10/1995 | |
| EP | 738605 | 10/1996 | |
| JP | 5-162244 | 6/1993 | |
| JP | 7-156934 | 6/1995 | |
| JP | 9-267483 | 10/1997 | |

* cited by examiner

*Primary Examiner*—Anh T. N. Vo
(74) *Attorney, Agent, or Firm*—Fitzpatrick, Cella, Harper & Scinto

(57) ABSTRACT

A liquid container comprises an inner wall that forms the liquid containing portion to contain liquid therein; an outer wall that forms the container to contain the liquid containing portion therein; and a liquid supply portion for supplying liquid from the liquid containing portion to the outside. Then, the inner wall is arranged to be a member to generate negative pressure in the liquid containing portion by being deformed following the leading-out of the liquid, and also, formed by the material having an elastic modulus change of 25% or less against the temperature change of use environment. With the liquid container thus structured, it is possible to implement the stable supply of liquid by stabilizing the characteristic of negative pressure in the liquid containing portion thereof irrespective of the temperature changes of use environments.

16 Claims, 10 Drawing Sheets

FIG. 2A1
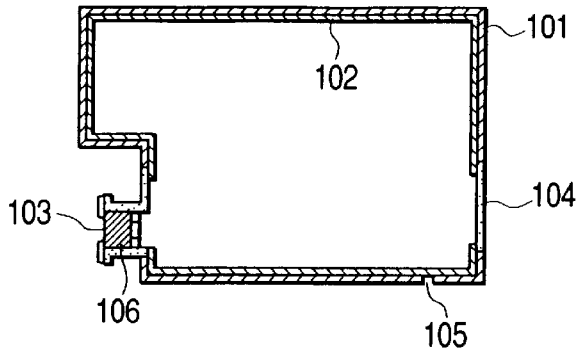
FIG. 2A2
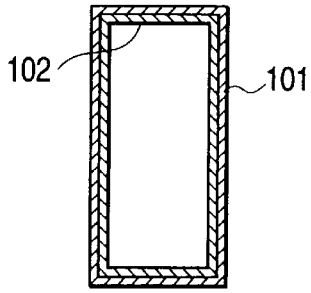
FIG. 2B1
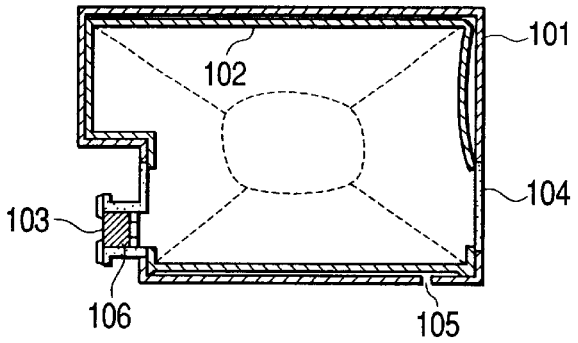
FIG. 2B2
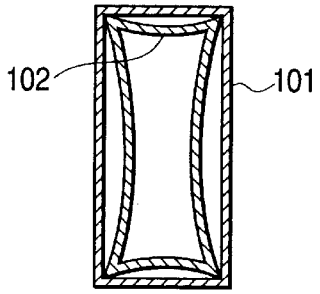
FIG. 2C1
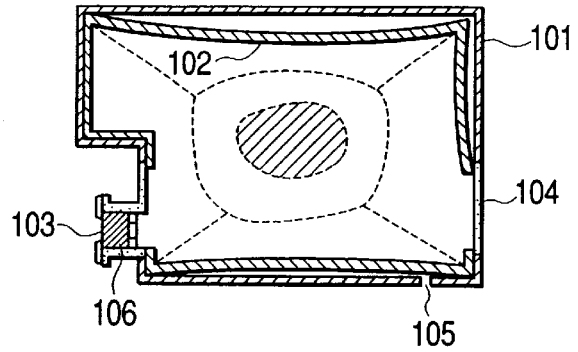
FIG. 2C2
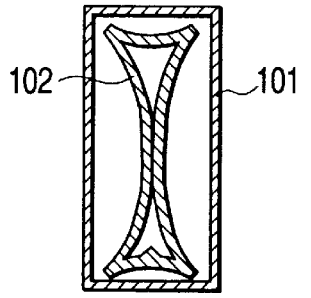
FIG. 2D1
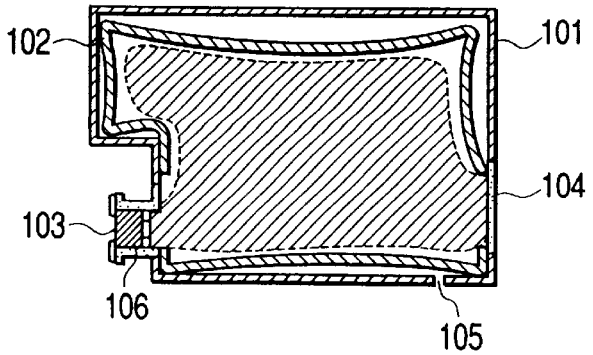
FIG. 2D2
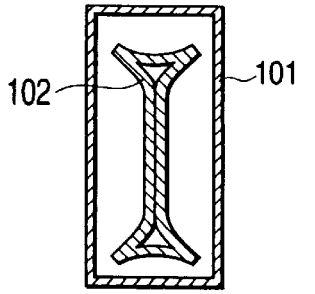

FIG. 6A1
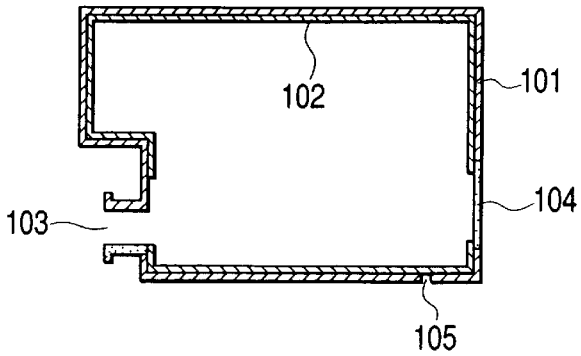
FIG. 6A2
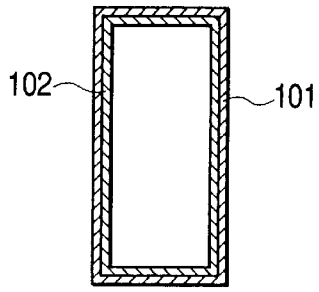
FIG. 6B1
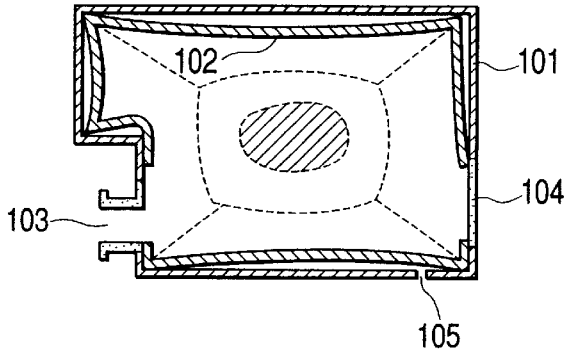
FIG. 6B2
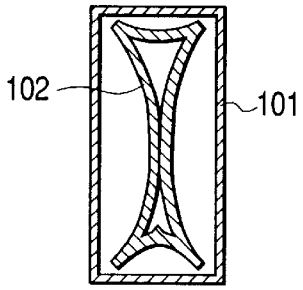
FIG. 6C1
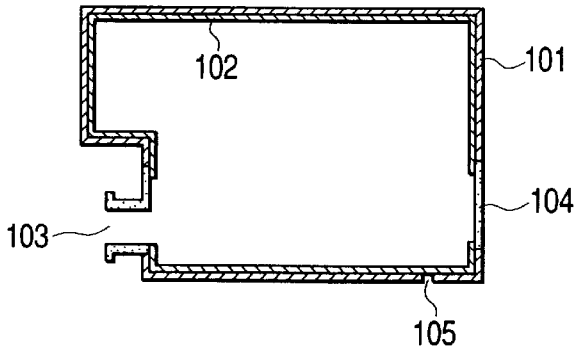
FIG. 6C2
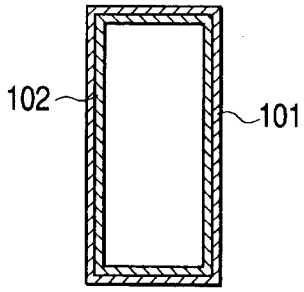
FIG. 6D1
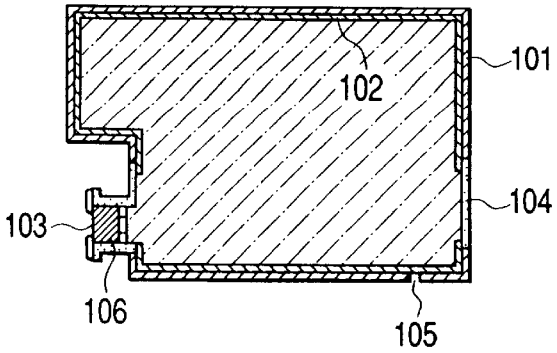
FIG. 6D2
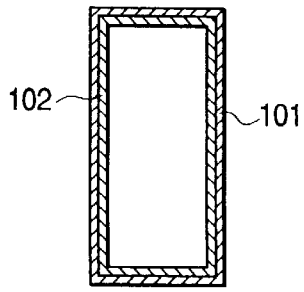

LIQUID CONTAINER, LIQUID SUPPLY SYSTEM, AND METHOD FOR MANUFACTURING SUCH LIQUID CONTAINER

BACKGROUND OF THE INVENTION

1. Field of the Invention

The present invention relates to a liquid container that utilizes negative pressure for supplying liquid to the outside. The invention also relates to a liquid supply system and a method for manufacturing such liquid container.

2. Related Background Art

As disclosed in the specification of Japanese Patent Application Laid-Open No. 9-267483 filed by the applicant hereof, there has been known conventionally the ink tank having ink contained in an area (hereinafter referred to as an ink containing portion) surrounded by the inner walls which are separable from the outer walls that form the outer enclosure thereof.

The inner walls of the aforesaid ink tank are formed sufficiently thicker than the outer walls so that the outer walls present almost no deformation even when the inner walls are deformed by the outflow of ink contained therein. Also, the air intake is provided for the outer walls to induce the air into the gap between the outer walls and the inner walls. For the inner walls, the welding portions (pinch offs) are provided to support the inner walls by the welding portions to enable them to engage with the outer walls.

For the ink tank thus structured, the force exerted by the deformation due to the consumption of ink acts upon the inner walls thereof, together with the force that may be exerted by the restoring action thereof to return its shape to the initial state. This contributes to making negative pressure more stable in the ink container, and also, making the ink tank excellently functional in utilizing such stabilized negative pressure while supplying liquid.

Also, in the specification of the aforesaid Japanese Patent Laid-Open Application, it has been disclosed that the inner and outer walls of the ink tank are structured with multiple layers of different materials in order to enhance its shock resistance.

Now, a printer is often used under the environment having a specific temperature, although the use environment of a printer in general differs greatly depending on the regions where it is used.

In actual cases, there is a region where the temperature is considerably changeable or a region where the temperatures are considerably different even in a day. Here, the inventors hereof have found that the negative pressure changes even when the degree of deformation is the same if the ink tank is used in a condition where the temperatures may change as described above. Then, it is also known that even with an ink tank which is capable of demonstrating the desired characteristic of negative pressure at a certain specific temperature, there is a possibility that such desired characteristic of negative pressure becomes unobtainable due to its fluctuation that may be caused by the environmental condition where the temperature changes greatly against the temperature thus set specifically. In this case, there is a need for the adjustment of negative pressure, such as increasing the frequency of recovery process more than usual so that the ink leakage is prevented from the recording head when printing is made under such environment that its temperature is caused to differ greatly from the one thus set specifically.

Therefore, the inventors hereof have studied assiduously to ascertain the causes in this respect, and succeeded in obtaining the new knowledge that there is an important relationship between the elastic moduli of resin used as the material of the inner walls, which may change due to the temperature changes, the temperature at the glass transition point (that is, the temperature at which molecules begin micro-Brownian motion and the characteristic changes from glass to rubber), and the temperature of use environment.

Also, since the ink tank contains ink or some other liquid in it, the ink tank should be made to present an excellent liquid contactness with ink (that is, it does not affect the composition of ink when it is in contact with ink), and also, present an excellent gas barrier capability. However, these functional resins are generally subjected to being peeled off from each other thus making it necessary to provide a bonding layer between them in order to bond the resin layers firmly with each other.

On the other hand, the ink tank, which has been disclosed in the aforesaid specification of Japanese Patent Laid-Open Application, is manufactured by expanding a cylindrical parison in the mold the section of which is square column so that the ink tank has a thickness distribution. As a result, when the inner walls should be formed with multiple layers, the central part of each layer is made relatively thicker than each of the corner portions, thus making the thickness distribution to change smoothly from the central portion to the corners eventually. As a result, if the contact layers should be provided in order to allow the multiple layers to be in contact reliably with each other, the thickness of the contact layers increases inevitably centering on the central portion, which makes the thickness larger for the inner walls as a whole.

SUMMARY OF THE INVENTION

Now, therefore, the present invention is designed with a view to solving the problems discussed above. It is an object of the invention to provide a liquid container capable of implementing the stable supply of liquid by stabilizing the characteristic of negative pressure irrespective of the temperature changes of use environments, and also, to provide a liquid supply system and a method for manufacturing such liquid container as well.

In order to achieve the objects described above, the liquid container of the present invention comprises the inner wall that forms the liquid containing portion to contain liquid therein; the outer wall that forms the container to contain the liquid containing portion therein; and the liquid supply portion for supplying liquid from the liquid containing portion to the outside. Then, the aforesaid inner wall is arranged to be a member to generate negative pressure in the liquid containing portion by being deformed following the leading-out of the liquid, and formed by the material having the elastic modulus change of 25% or less against the temperature change of use environment.

In accordance with the liquid container of the present invention thus structured, it becomes possible to stabilize the characteristic of negative pressure irrespective of the temperature changes of the use environment whether the material of the inner walls is an amorphous resin or a crystalline resin.

Also, the liquid container of the present invention comprises the inner wall that forms the liquid containing portion to contain liquid therein; the outer wall that forms the container that contains the liquid containing portion therein; and the liquid supply portion for supplying liquid from the liquid containing portion to the outside. Then, the aforesaid inner wall is arranged to be a member to generate negative pressure in the liquid containing portion by being deformed following the leading-out of liquid, and formed by an amorphous resin material having a higher glass transition temperature than the maximum temperature of use environment.

Also, the liquid container of the present invention comprises the inner wall that forms the liquid containing portion for containing liquid therein; the outer wall that forms the container that contains the liquid containing portion therein; and the liquid supply portion for supplying liquid from the liquid containing portion to the outside. Then, the aforesaid inner wall is arranged to form a multiply layered structure comprising an oxygenproof permeable layer, a resistive layer against the environmental change of temperature, and a liquid resistance layer. Then, the liquid resistance layer is provided for the innermost layer which is in contact with the liquid. The resistive layer against the environmental temperature change is formed by an amorphous resin having a higher glass transition temperature than the maximum temperature of use environment. Then, the inner wall is structured to generate negative pressure in the liquid containing portion by being deformed following the leading-out of liquid.

Since the amorphous resin has almost a constant elastic modulus at the temperatures lower than the glass transition temperature thereof without being affected by them then, it is possible to stabilize the characteristic of negative pressure if the inner walls are formed by an amorphous resin material having a higher glass transition temperature than the maximum temperature of the use environment, hence implementing a stable supply of liquid irrespective of the temperature changes of the use environment.

Further, the resistive layer against the environmental temperature change of the inner wall is provided between the liquid resistance layer and the oxygenproof permeable layer. At the same time, this layer may be structured to contain a functional bonding resin material or it may be possible to provide the oxygenproof permeable layer between the liquid resistance layer and the resistive layer against the environmental temperature change, and to contain a functional bonding resin material in this layer.

In this manner, the outermost layer and the innermost layer that form the inner walls are integrally formed together with the intermediate layer to which the functional bonding resin material is added to suppress increasing the thickness of the inner walls as compared with those produced by the conventional art in which the bonding layers are arranged, hence making the changes of negative pressure smoothly.

Also, the resistive layer against the environmental temperature change of the inner wall may be structured to provide the elastic modulus of 15% change or less along the temperature change of the use environment.

Further, this layer may be arranged to be installed in the container of the negative pressure generating member which is capable of creating the gas-liquid exchange that may lead out liquid by inducing gas into the liquid container through the liquid supply portion.

Also, the liquid supply system of the present invention is provided with the container of a negative pressure generating unit capable of creating the gas-liquid exchange that may lead out liquid by inducing gas into the liquid container through the liquid supply portion.

Since the liquid container of the present invention can stabilize the characteristic of negative pressure irrespective of the temperature changes of the use environment, it becomes possible to reduce more the buffer space to be arranged in the container of the negative pressure generating member by structuring the liquid supply system using this liquid container.

Further, the structure may be arranged so that the liquid container is detachably mountable on the container for the negative pressure generating member.

Also, the method of the present invention for manufacturing the liquid container, which is provided with the inner wall that forms the liquid containing portion to contain liquid therein, the outer wall that forms the container that contains the liquid containing portion therein, and the liquid supply portion for supplying liquid from the liquid containing portion to the outside, comprises the steps of preparing a mold corresponding to the outer contour of the liquid container, a substantially cylindrical first parison having a diameter smaller than that of the mold for use of the outer wall, and a second parison for use of the inner wall; and forming the outer wall and the inner walls of the liquid container by injecting the air inside to expand the first and second parisons to follow the mold so as to make the area formed by the inner wall and the area formed by the outer wall separable and substantially analogous. Then, the step of preparing the second parison for use of the inner wall comprises the step of preparing a multiply layered structure containing an oxygenproof permeable layer, a resistive layer against the environmental temperature change, and a liquid resistance layer.

In this manner, it is possible to implement a stable liquid supply with the stabilized characteristic of negative pressure irrespective of the temperature changes of the use environment.

Further, it may be possible to arrange the step of preparing the second parison for use of the inner wall to comprise a step of forming the second parison to be provided between the resistive layer against the environmental temperature change and the oxygenproof permeable layer, and a step of containing a functional bonding resin material in the resin that forms the resistive layer against the environmental temperature change or it may be possible to arrange the step of preparing the second parison for use of the inner wall to comprise a step of forming the second parison to be structured so as to provide the oxygenproof permeable layer between the liquid resistance layer and the resistive layer against the environmental temperature change, and a step of containing a functional bonding resin material in the resin that forms the oxygenproof permeable layer.

Further, it may be possible to form all the layers with a material that mainly contains ethylene or propylene as the skeletal structure thereof. Then, it becomes possible to manufacture a liquid container, while suppressing the increase of the thickness of the inner walls unlike the conventional art which necessitates the provision of bonding layers for bonding the innermost layer, the intermediate layers, and the outermost layer together.

BRIEF DESCRIPTION OF THE DRAWINGS

FIGS. 2A1, 2A2, 2B1, 2B2, 2C1, 2C2, 2D1 and 2D2 are views which schematically illustrate changes in the sequence from A to D when the ink, which is contained in the ink tank shown in FIGS. 1A to 1C, is led out from the ink supply unit of the ink tank.

FIGS. 6A1, 6A2, 6B1, 6B2, 6C1, 6C2, 6D1 and 6D2 are views which schematically illustrate each of the steps in the manufacturing process of the ink tank in accordance with the present invention.

DETAILED DESCRIPTION OF THE PREFERRED EMBODIMENTS

Now, with reference to the accompanying drawings, the description will be made of the embodiments in accordance with the present invention.

Figure 1A:
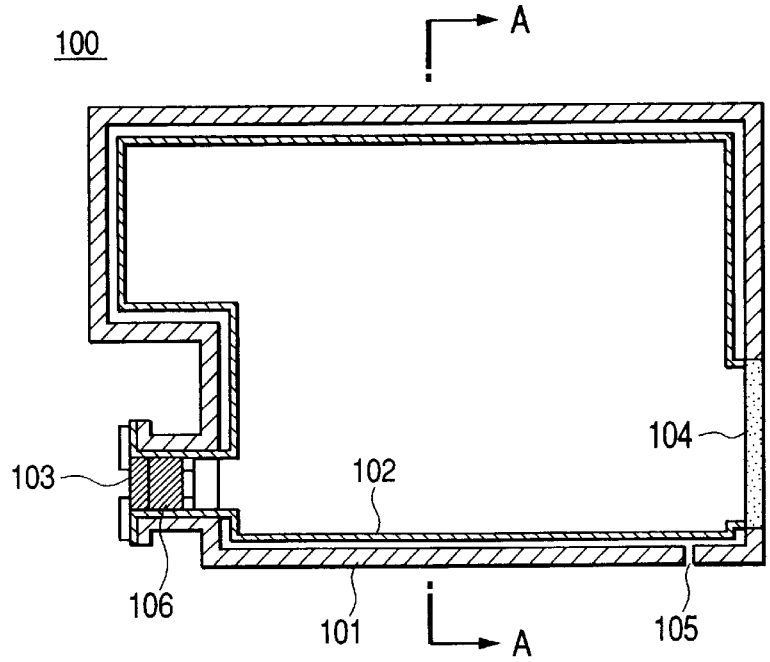
FIGS. 1A, 1B and 1C are views which schematically illustrate an ink tank in accordance with one embodiment of present invention.
Figure 1B:
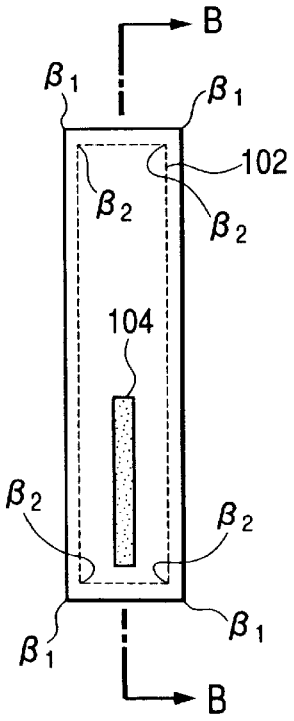
Figure 1C:
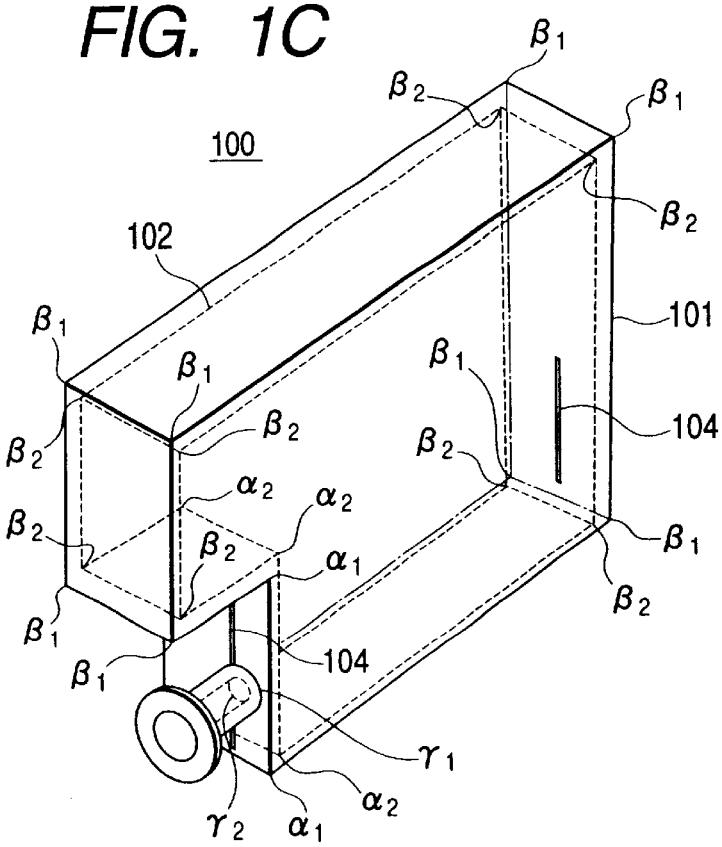

FIGS. 1A to 1C are views which schematically illustrate an ink tank in accordance with one embodiment of the present invention. FIG. 1A Is a cross-sectional view. FIG. 1B is a side view. FIG. 1C is a perspective view. FIGS. 2A1 to 2D2 are views which schematically illustrate changes in the sequence from A to D when the ink, which is contained in the ink tank shown in FIGS. 1A to 1C, is led out from the ink supply unit of the ink tank. Here, FIGS. 2A1, 2B1, 2C1 and 2D1 are cross-sectional views taken along line B–B in FIG. 1B. FIGS. 2A2, 2B2, 2C2 and 2D2 are cross-sectional views taken along line A—A in FIG. 1A.

The ink tank 100 of the present embodiment shown in FIGS. 1A to 1C contains ink in the area (hereinafter referred to as an ink containing portion) surrounded by the inner walls 102 which are separable from the outer walls 101 which form the enclosing walls. The outer walls 101 are arranged to structure the container of the ink containing portion to house the ink containing portion. Also, the outer walls 101 are sufficiently thicker than that of the inner walls 102. There is almost no deformation of the outer walls even if the inner walls 102 are deformed when ink flows out. Also, an air inlet 105 is provided for the outer walls. The welding portions (pinch offs) 104 are provided for the inner walls. The inner walls are supported by the welding portions so as to engage with the outer walls.

Here, the ink tank is described in detail in accordance with FIGS. 1A to 1C. The ink tank 100 are structured with eight flat faces, and the cylindrical ink supply unit 103 is added to them as a carved face. Of the eight faces, those having the maximum area for each of the inner and outer walls on both sides of the ink supply unit 103 are partitioned by the six corner portions ($\alpha$1, $\beta$1, $\beta$1, $\beta$1, $\beta$1, and $\alpha$1), ($\alpha$2, $\beta$2, $\beta$2, $\beta$2, $\beta$2, and $\alpha$2).

The thickness of the inner wall area which present the maximum area is thinner on the portions that form the corners than the central area of each face of the substantially polygonal column. This thickness is gradually made smaller from the central portion of each face toward each of the corners, respectively. The ink containing side is formed to be convex. In other words, this direction is the same as the one in which deformation is made, hence producing an effect in promoting the deformation of the ink containing portion.

Here, the corners of the inner walls are formed by three faces. Consequently, the strength of the corners of the inner walls is relatively greater as a whole than that of the central region. Also, in terms of the extended planes thereof, the thickness is smaller than that of the central region, which makes it easer to allow the movement of the planes as described later. It is desirable to make the thickness substantially equal for each of the portions that form the corners of the inner walls.

Also, the ink supply unit 103 is connected with the ink lead-out tube of ink jet recording means (not shown) through the ink lead-out admission member 106 which is provided with the ink leakage preventive function to prevent it from occurring even when slight vibrations or external pressure is exerted on the ink tank (this is called the "initial state" hereinafter). The ink supply unit 103 is structured so that the inner walls and the outer walls are not easily separated by the provision of the ink lead-out admission member 106 and the like. Further, the ink supply unit is almost cylindrical, and the $\gamma$1 and $\gamma$2, at which the curved face of the cylinder intersects the flat surface as described later, are provided with the characteristic that these intersections are not easily collapsed by the deformation of the inner walls caused by the lead-out of ink following the ink discharges from the usual ink jet recording means. In accordance with the present embodiment, the ink supply unit of the ink tank is almost cylindrical. However, it is not necessarily limited to the cylindrical shape. It may be a polygonal column. In this shape, too, the size of the ink supply unit is sufficiently smaller than that of the ink containing portion to make it possible to maintain equally such characteristic that it cannot be collapsed easily by the deformation of the inner walls that follows the lead-out of ink. Therefore, it is still possible to maintain the initial state in the ink supply unit where the inner walls and the outer walls are not allowed to be deformed even when ink is completely consumed.

In this respect, the outer walls 101 of the ink tank and the inner walls 102 of the ink tank are represented in the schematic FIGS. 1A to 1C and FIGS. 2A1 to 2D2 as if to maintain the positional relations between them with a gap. In practice, however, the inner walls and the outer walls may be structured to be in contact or arranged with a slight gap to separate them if only these walls are in a state of being separable. Therefore, whether in either cases or in the initial state, the ink tank is formed so that the corners $\alpha$2 and $\beta$2 of the inner walls 102 are positioned at least corresponding to the corners $\alpha$1 and $\beta$1 of the outer walls 101 following the shape of the inner face of the outer walls 101 (FIGS. 2A1 and 2A2).

Here, the corners of an ink tank formed by a substantially polygonal member are meant to include at least three faces or more preferably, the intersecting portion of the three faces or the portion corresponding to the extended face of such intersecting portion. Here, the reference mark $\alpha$ given to the corners indicates the corners formed by the faces having the ink supply unit, and the reference mark $\beta$ indicates the other corners. The adscript 1 indicates the outer walls. The adscript 2 indicates the inner walls. Also, the ink supply unit is formed to be substantially cylindrical. Here, the reference mark γ indicates the intersecting portion of the curbed face of the cylinder and the essentially flat surface. In this intersecting portion, the outer walls and the inner walls are positioned correspondingly. Then, hereinafter, these members are designated also by the reference marks γ1 and γ2, respectively. In this respect, it may be possible to structure the corners with slightly curbed faces. The faces in this case are defined as the flat faces without such slight curved faces just by regarding the slightly curved faces of the polygonal member as the corners simply.

Now, when ink in the ink containing portion begins to be consumed after ink is discharged from the recording head, the inner walls 102 begin to be deformed from the central portion of the face having the maximum area in the direction in which the volume of the ink containing portion is reduced. Here, the outer walls function to suppress the deformation of the corners of the inner walls. For the ink tank of the present embodiment, there is almost no change in each corner position partitioned by the corners α2 and β2 as described above. Therefore, the ink containing portion functions in the direction in which negative pressure is stabilized by the active force exerted by the deformation following the ink consumption, together with the active force whereby to restore the shape to the initial state.

At this juncture, the air is induced from the air inlet 105 into the gap between the inner walls 102 and the outer walls 101 and functions to maintain negative pressure stably without impeding the deformation of the inner walls when ink is used. In other words, the air that resides in the gap between the inner walls and the outer walls is communicated with the air outside through the air inlet 105. After that, with the balance between the force exerted by the inner walls and the force exerted by the meniscus at each of the discharge ports of the recording head, ink in the ink containing portion is held (FIGS. 2B1 and 2B2).

Then, when the considerable amount of ink is led out to the outside from the ink containing portion (FIGS. 2C1 and 2C2), the ink containing portion is deformed as in the previous description, thus maintaining the state of stable collapse of the central region of the ink containing portion in the direction toward the inner side. Further, the welding portion 104 also becomes the one that regulates the deformation of the inner walls. On the face adjacent to the face having the maximum area, the deformation begins relatively earlier in the portions where no pinch offs are provided than in the area where the pinch off portions 104 are provided, thus parting from the outer walls.

Nevertheless, only with the provision of the portion where deformation of the inner walls is regulated, there is still a fear that the ink supply unit is clogged by the deformation of the inner walls in the vicinity of the ink supply unit so that ink in the ink containing portion is not sufficiently consumed eventually.

In accordance with the present embodiment, the corner of the inner walls at the reference mark α2 shown in FIG. 1C is formed along with the corner at the α1 of the outer walls in the initial state. Therefore, when the inner walls are deformed, it becomes more difficult for the corner of the inner walls at the reference mark α2 to be deformed as compared with the other portions of the inner walls, hence regulating the deformation of the inner walls after all. In this respect, the angle formed by a plurality of corners of the inner walls at the reference mark α2 is represented as 90 degrees for the ink tank of the present embodiment.

Here, the angle of the corners α2 of the inner walls is defined as the angle formed by at least the two faces of the three faces that form the flat face shape essentially which structures the corners α1 of the outer walls. In other words, the angle thereof is defined as the angle of the portion where the extensions of the two faces intersect. The angle of the corners of the inner walls is defined by the angle of the corners of the outer walls here. This is because the manufacture is executed with the outer walls as its criterion in the manufacturing process which will be described later, while the inner walls and the outer walls are substantially analogous in the initial state as described earlier.

Here, therefore, as shown in FIGS. 2C1 and 2C2, the corners α2 of the inner walls shown in FIG. 1C are positioned to be separable from the corners α1 of the corresponding outer walls. On the other hand, the corners β2 of the inner walls other than the corners which are formed by faces having the ink supply unit should become slightly apart from the corresponding corners β1 of the outer walls as compared with the corners designated by the reference mark α2. However, for the embodiment represented in FIGS. 1A to 1C and FIGS. 2A1 to 2D2, the corners β in the facing positions are often formed at an angle of 90 degrees or less, too. Therefore, as compared with the other inner wall regions that form the ink containing portion, it becomes possible to keep the relations with the corresponding outer walls in a position close to the initial state, hence implementing the auxiliary support for the inner walls.

Further, in FIGS. 2C1 and 2C2, the faces having the maximum surface areas, which are opposite to each other, are deformed almost simultaneously so that the central portions of the ink containing portion are in contact with each other. The sections of the central portions, which are in contact (indicated by the slanted lines in FIGS. 2C1 and 2D1), are expanded more as ink is lead out more. In other words, when ink is led out from the ink tank of the present embodiment, the face having the maximum area and the face opposite to it are in contact with each other before the edges formed by the faces having the maximum areas and the faces adjacent thereto are caused to be bent.

Then, ink in the ink containing portion is almost consumed completely in due course (hereinafter referred to as the "last state"). FIGS. 2D1 and 2D2 illustrate this state.

In this state, the contacted sections of the ink containing portion have expanded almost the entire regions of the ink containing portion. Then, some of the corners β2 of the inner walls are completely apart from the corresponding corners β1 of the outer walls. On the other hand, the corners α2 of the inner walls are in a position to be separable from the corresponding corners α1 of the outer walls even in the last state, thus becoming to function as the deformation regulating portions to the last.

Further, in this case, depending on the thickness of the inner walls, the welding portion 104 may be apart from the outer walls. However, with the length component provided for the welding portion 104, it is still possible to regulate the direction in which it is deformed. As a result, even when the welding portion parts from the outer wall, the deformation thereof is not irregular. The deformation is made while keeping a good balance eventually.

As has been described above, ink is contained in the ink containing portion of the ink tank of the present embodiment, and then, changes are made when ink is led out from the ink supply unit. Here, the ink tank is structured to provide the order of priority for deformation when it is deformed, beginning with the deformation of the faces having the maximum areas, and allowing such faces to be in contact with the opposite faces before the edges formed by the faces having the maximum areas and the adjacent faces are caused to be bent, and then, moving the corners other than the corners which are formed by the faces having the ink supply unit.

Now, the description will be made of the ink tank in accordance with the embodiments of the present invention as has been described above.

(First Embodiment)

The inner walls 102 of the ink tank 100 shown in FIGS. 1A to 1C are formed by different materials. Then, the characteristic of negative pressure by the temperature changes is examined in accordance with each of the materials used for the inner walls.

The results of the examinations are shown in the following Table 1 where the capacity of the ink tank is 12 cc; the thickness of the inner walls 102 is approximately 200 $\mu$m (hereinafter referred to as the "maximum thickness"); the width of the ink tank is approximately 10 mm; and the environmental temperatures are 5° C. and 35° C.

TABLE 1

| Material | 5° C. | 35° C. | Changes in negative pressure characteristic |
|---|---|---|---|
| PET | −95 mmAq. | −96 mmAq. | OK |
| APL | −115 mmAq. | −110 mmAq. | OK |
| HDPE (Comparative Example) | −140 mmAq. | −30 mmAq. | NG |

As shown in the above table 1, the characteristic of negative pressure is obtained in good condition practically when the inner walls are formed by PET (polyethylene terephthalate) or APL (Apel:registered trade mark by Mitsui Kagaku Kabushiki Kaisha). However, it is impossible to obtain the good characteristic of negative pressure in practice with the comparative example which is formed by HDPE (high density polyethylene). Here, the APEL (referred to as "APL" in this specification) is a kind of amorphous polyolefine resin with the ethylene base that becomes the skeletal structure, which also forms a ring structure.

Figure 3:
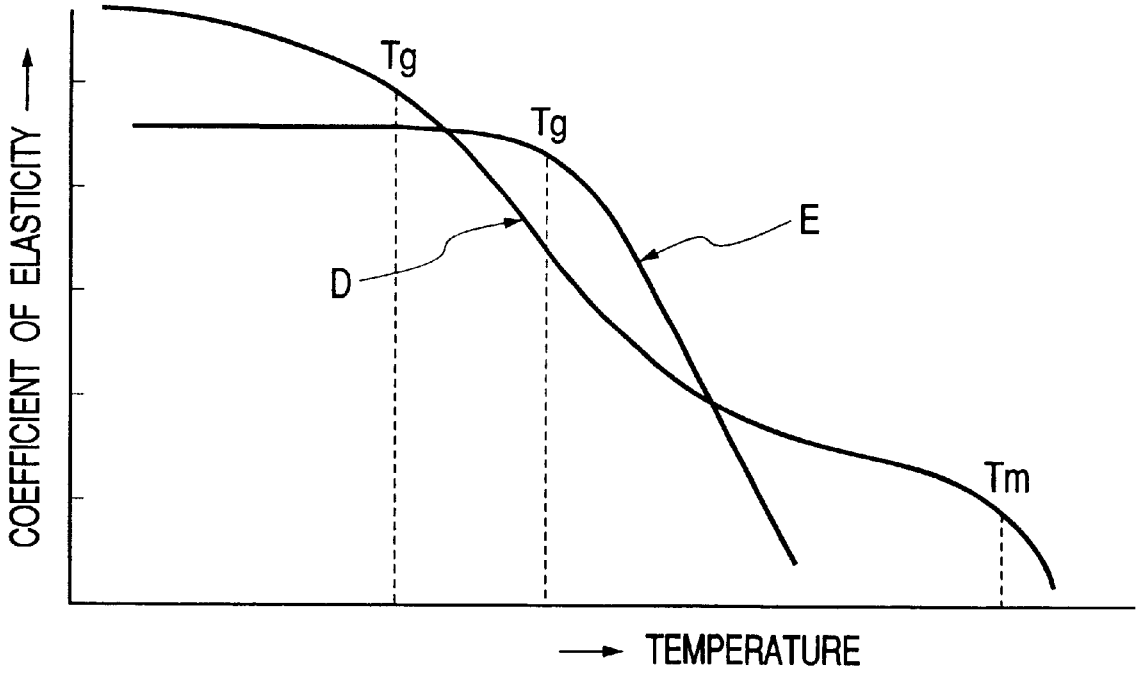
FIG. 3 is a graph which shows the relationship between the temperatures and the elastic modulus of the crystalline resin and the amorphous resin, respectively.

Here, the APL is an amorphous resin whose glass transition temperature is approximately 80° C. and 140° C., respectively. Also, as shown in FIG. 3, when an amorphous resin, such as APL, is used, the elastic modulus is almost constant at the temperatures less than the glass transition temperature. In contrast, the crystalline resin, such as HDPE, the elastic modulus changes depending on the temperatures even if the temperature is lower than the glass transition temperature, and also, in the range where the temperature is higher than the glass transition temperature, the changing ratio of the elastic modulus becomes greater in some cases. Here, in FIG. 3, the reference marks D and E correspond to the crystalline resin and the amorphous resin, respectively.

As described above, in accordance with the present embodiment, it becomes possible to implement the stable ink supply irrespective of the use environment by use of the amorphous resin whose glass transition temperature is higher than the maximum environmental temperature.

Here, the Table 2 shows the changes in the elastic modulus and others of the inner walls formed by APL or HDPE, which also function as the resistive layer against the environmental temperature changes, when the use environment is set at 5° C. and 35° C., respectively.

TABLE 2

| Material | 5° C. | 35° C. | Changes in elastic modulus | Changes in negative pressure characteristic |
|---|---|---|---|---|
| APL | 22000 kgf/cm$^2$ | 20000 kgf/cm$^2$ | 10% | OK |
| HDPE | 16000 kgf/cm$^2$ | 8000 kgf/cm$^2$ | 50% | NG |

As clear from the Table 2, if the changing ratio of the elastic modulus of the inner walls is great at the minimum temperature and the maximum temperature in the use environment, the negative pressure, which is generated in the ink tank, is also caused to change. This is because the ink tank of the present invention generates negative pressure when the inner walls are deformed following the lead-out of ink. For the flat type ink tank shown in FIGS. 1A to 1C, the negative pressure is generated mainly by the changes in the restoring force of the deformation of the faces having the maximum areas, which tends to return to the original state following the lead-out of ink.

The smaller the changes of the elastic modulus of the inner walls (that is, the two layers as a whole if the inner walls are structured with two layers, for example, and the three layers as a whole if the inner walls are structured with three layers), the better. In practice, however, it is preferable to make the changing ratio of the elastic modulus of the inner walls 25% or less as the range applicable to the ink tank used in the field of ink jet recording. It is preferable to make it 15% or less as applied to its function as the resistive layer against the environmental temperature changes. With a material of the kind used for the inner walls, it becomes possible to implement the stable ink supply irrespective of being crystalline or amorphous without depending on the temperature changes of the use environment. For the crystalline resin which satisfies the changing ratio of 15% elastic modulus or less, there is the aforesaid PET (whose elastic modulus is approximately 20,000 kgf/cm$^2$ at the environmental temperature of 23° C.) among some others.

In this respect, if the upper limit of the use environmental temperature is 50° C., an amorphous resin whose glass transition temperature is higher than such upper limit is used. However, it may be possible to use the material whose changing ratio of elastic modulus is within the aforesaid range at the temperatures of 5° C. and 50° C.

(Second Embodiment)

The outer walls 101 and inner walls 102 of the ink tank 100 can be formed by use of various material, respectively. Further, the inner walls 102 can be formed by laminating a plurality of layers made by various materials.

Figure 10:
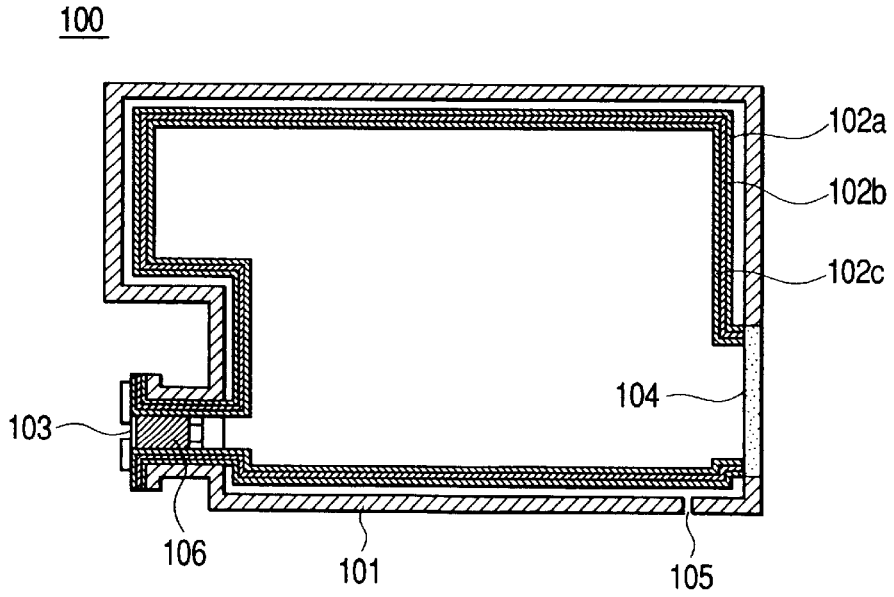
FIG. 10 is a view which schematically shows an ink tank having the three-layered structure of the inner walls thereof in accordance with one embodiment of the present invention.

The inventors hereof have prepared an ink tank as the structural example A thereof (see FIG. 10) by structuring the outer walls 101 by use of PP (polypropylene) of 1,000 $\mu$m thick, and also, by structuring the inner walls with the outermost layer 102*a* formed by EVOH (saponified substance of EVA (ethylene vinyl acetate polymeric resin)) in a thickness of 10 to 15 $\mu$m, the intermediate layer 102*b* formed by a mixed resin having the APL of 200 to 230 $\mu$m thick and a functional bonding resin in it, and the innermost layer 102*c* formed by HDPE (high density polyethylene in a thickness of 60 $\mu$m, which are all laminated together. The thickness of the inner walls of this structural example A is approximately 300 $\mu$m.

The outermost layer formed by the EVOH functions as the oxygenproof permeable layer excellent in the gas barrier capability against oxygen. Also, the innermost layer formed by the HDPE functions as the ink resistance layer excellent in the liquid contactness with ink. Also, the intermediate layer formed by the mixed resin of the APL and functional bonding resin functions as the resistive layer against the environmental temperature changes which presents a smaller changes of the elastic modulus against the temperature changes as referred to in the description of the first embodiment. As in this functional example A, the layer having the excellent liquid contactness is provided for the innermost layer which is positioned closest to the ink containing portion to form the inner wall faces thereof. Further, with the provision of the layer excellent in gas barrier capability, it becomes possible to prevent effectively the characteristics of ink from being changed when ink is reserved for a long time.

In this respect, since the EVOH, APL, and HDPE are easily separated from each other, it is usually required to provide contact layers formed by functional bonding resin. However, if any of the contact layers are provided, a problem is encountered eventually that the thickness of the inner walls becomes greater as a whole. Now, therefore, in accordance with the present embodiment, the functional bonding resin formed by polyolefine is added to the APL of the intermediate layer in a pellet form at the weight ratio of 7:3. With this addition of the functional bonding resin to the APL, the outermost layer and innermost layer can be formed integrally with the intermediate layer so as not to allow them to become separable.

Also, it may be possible to arrange the structure in such a manner that the outermost layer and the intermediate layer is exchanged, that is, the outermost layer is formed by the APL, and at the same time, the intermediate layer is formed by the EVOH, while the functional bonding resin is added to the EVOH instead of adding it to the APL. However, if the functional bonding resin is added to the EVOH, its gas barrier capability is lowered. Therefore, as described at the outset, it is preferable to arrange the structure so that the intermediate layer is formed by the APL, and that the functional bonding resin is added to the APL.

If the additive ratio of the functional bonding resin is arranged so as to make the ratio of the APL greater than the 6:4 in terms of the weight ratio in the pellet condition, the intermediate layer formed by the APL and the bonding resin becomes the layer which can dominantly determine the changes of negative pressure against the temperature changes as referred to in the description of the first embodiment.

Also, in the state where the outermost layer, intermediate layer, and innermost layer are integrated not to be separable from each other, the changing ratio of the elastic modulus of the outermost layer and that of the innermost layer may be the factors upon which the intermediate layer is made to function as the layer which dominantly determines the changes of negative pressure against the temperature changes as referred to in the description of the first embodiment. For the structural example A described above, however, it is confirmed that the intermediate layer can function as the objective layer if only the ratio of the intermediate layer is 70% or more against the outermost layer and innermost layer.

In this respect, the APL of the intermediate layer is formed by ring type olefine copolymer, the functional bonding resin is formed by polyolefine, and the outer walls is formed by PP. Therefore, the ink tank of the structural example A has an excellent recycling property.

Also, the inventors hereof have prepared the structural examples B, C, and D to show the respective structures of the ink tank.

The structural example B is formed with the outer walls of PP in a thickness of 1,000 μm, and also, with the inner walls formed by laminating the outermost layer of EVOH in a thickness of 10 μm, the intermediate layer of the mixed resin having APL and functional bonding resin in it in a thickness of 150 to 200 μm, and the innermost layer of PP in a thickness of 10 μm.

The structural example C is formed with the outer walls of HIPS (shockproof polystyrene) in a thickness of 1,000 μm, and also, with the inner walls formed by laminating the outermost layer of PP and the functional bonding resin in a thickness of 20 μm, the first intermediate layer of EVOH in a thickness of 10 μm, the second intermediate layer of mixed resin having APL and functional bonding resin in it in a thickness of 150 to 200 μm, and the innermost layer of PP in a thickness of 10 μm.

The structural example D is formed with the outer walls of PP in a thickness of 1,000 μm, and also, with the inner walls formed by laminating the outermost layer of APL in a thickness of 200 μm, the intermediate layer of the mixed resin having EVOH and functional bonding resin in it in a thickness of 20 μm, and the innermost layer of PP in a thickness of 50 μm.

Further, the inventor hereof have prepared the comparative example with the outer walls formed by HIPS in a thickness of 1,000 μm, and also, with the inner walls formed by use of PP in a thickness of 250 μm.

The Table 3 shows the results of the comparisons between each of the structural examples described above, and the comparative example as to the gas-barrier capability, the moisture absorption of the inner walls, and the changes in the characteristic of negative pressure against the temperature changes, respectively. In Table 3, ⊙ denotes that characteristic is sufficiently satisfactory and stable; ○, characteristic is satisfactory and stable for practical use; Δ, characteristic is slightly unsatisfactory and stability is slightly inferior; and X, characteristic is not sufficiently satisfactory and state thereof changes with time, respectively.

TABLE 3

| Structural Example | Gas-barrier capability | Moisture absorption of inner walls | Changes in characteristic of negative pressure against temperature changes |
|---|---|---|---|
| A | ⊙ | Δ | ⊙ |
| B | ⊙ | Δ | ○ |
| C | ⊙ | ⊙ | ○ |
| D | ○ | ⊙ | ○ |
| Comparative Example | x | ⊙ | x |

Since EVOH which is used for the structural examples A and B, has moisture absorption, there is a fear that the gas-barrier capability changes when the EVOH of the outermost layer absorbs moisture, (but the inner walls are released to the air outside with a gap formed by a space between the outer walls and inner walls, and thus, the inner walls are protected as compared with the condition in which the inner walls are exposed to the air outside directly). For the structural examples C and D, on the other hand, the layer formed by EVOH is protected by the outermost layer formed by PP or APL, thus suppressing the moisture absorption of the inner walls.

Here, for the above description, an example is shown to form the oxygenproof permeable layer with EVOH, the ink resistance layer with PP or PE, and the resistive layer against the environmental temperature changes with APL. Besides, it may be possible to form the oxygenproof layer with EVOH or PET, the ink resistance layer with PP, PE, NORYL (the registered trade mark of US GE Plastics, Inc.), or polysulfone, and the resistive layer against the environmental temperature changes with an amorphous resin having a higher glass transition temperature than the environmental temperature, PET, or PBT (poly-butylene terephthalate).

Now, the detailed description will be made of the method for manufacturing the ink tank of the present embodiment.

The ink tank provided by the present invention adopts the double-wall structure formed by molding resin material. Then, the outer walls are made thicker to provide strength, while soft material is used for the inner walls to make it thinner still. Hence, it is made possible to follow the voluminal changes of ink contained in the ink tank. It is desirable to use a material having ink resistance for the inner walls, and the one having shock proof or the like for the outer walls.

For the present embodiment, the blow molding that uses blowing air is adopted for the method for manufacturing the ink tank. This is because the walls that form the ink tank are structured by use of the resin which is not essentially stretched. In this manner, the inner walls that form the ink containing portion are made to withstand substantially even negative pressure in all the directions. Therefore, even if ink contained in the inner walls of the ink tank should swing in any direction particularly in a state where ink has been consumed to a certain extent, the inner walls of the ink tank is able to retain ink reliably, hence improving the overall durability of the ink tank.

As the blow molding method, there are the injection blowing, the direct blowing, and the double wall blowing, among some others. For the present embodiment, the direct blow molding method is adopted in order to obtain the aforesaid functional effect by use of the resin which is not essentially stretched.

Now, with reference to FIG. 4A to FIG. 7B, the detailed description will be made of the manufacturing processes using the direct blow molding for the ink tank of the present embodiment.

FIGS. 4A to 4D are views which illustrate the manufacturing process of an ink tank in accordance with the present invention. FIG. 5 is a flowchart which shows the manufacturing process of the ink tank in accordance with the present invention. FIGS. 6A1 to 6D2 are views which schematically illustrate each of the steps in the manufacturing process of the ink tank in accordance with the present invention. Here, the adscript 1 designates the face having the maximum surface area of the ink tank, and then, the adscript 2 designates the section parallel to the edge face of the ink tank in the central portion thereof in this case.

In FIGS. 4A to 4D, a reference numeral 201 designates the main accumulator that supplies the inner wall resin; 202, the main extruder that extrudes the inner wall resin; 203, the sub-accumulator that supplies the outer wall resin; and 204, the sub-extruder that extrudes the outer wall resin.

At first, the resin extruded from the main extruder to become the inner walls, and the resin extruded from the sub-extruder to become the outer walls are extruded into the hollow cylindrical mold one after another, thus preparing the cylindrical parisons. In this case, the resin on the inner side and the one on the outer side may be in contact without any problem or all of them are not in contact at all without any problem when resins are supplied. Also, it may be possible to arrange the structure so that resins are in contact partly. Here, in this case, for the surface where the inner resin and the outer resin are in contact, it is necessary to select materials which do not allow them to be fused together, respectively, or make them separable by adding a chemical compound to either one of the resins when supplied into the mold. Also, if it is required to use the same sort of materials in consideration of the liquid contactness with ink and desired configuration, it may be possible to supply resin so that a different kind of material is positioned on the contact surface, while the material used for the inner walls or the material used for the outer walls is formed in a multiply layered structure. Here, it is ideal to uniformalize the supply of inner resin all over the circumference, but it may be possible to make the supply thereof thinner locally so that it can easily follow the changes of the inner pressure. The method for making it locally thinner may be selected by the inner structure of a target ink tank or to arrange the formation in the direction of resin to be supplied into the mold.

The outer wall resin and inner wall resin supplied in this manner are supplied into the mold 206 through the ring 205 (steps S301 and S302). Then, the first and second parisons are formed altogether to become the parison 207, which descend in the air outside (step S303). In this respect, the resin, which is formed by laminating the ink (liquid) resistance layer, the resistive layer against the environmental temperature changes (amorphous resin layer), and the oxygenproof permeable layer, is prepared as the inner wall resin. Here, the resin that forms the resistive layer against the environmental temperature changes contains the functional bonding resin.

Figure 4A:
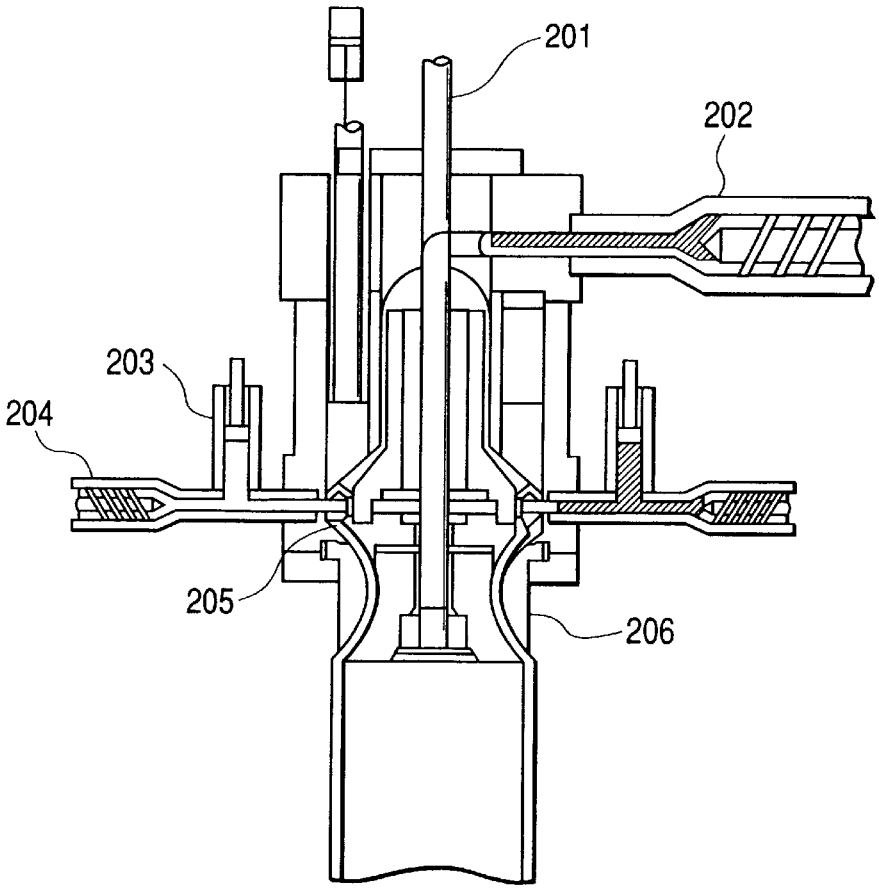
FIGS. 4A, 4B, 4C and 4D are views which illustrate the manufacturing process of an ink tank in accordance with the present invention.
Figure 4B:
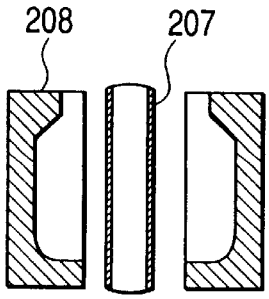
Figure 4C:
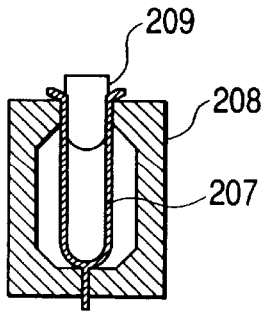
Figure 4D:
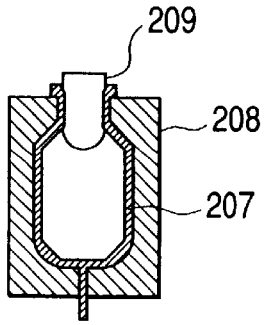
Figure 5:
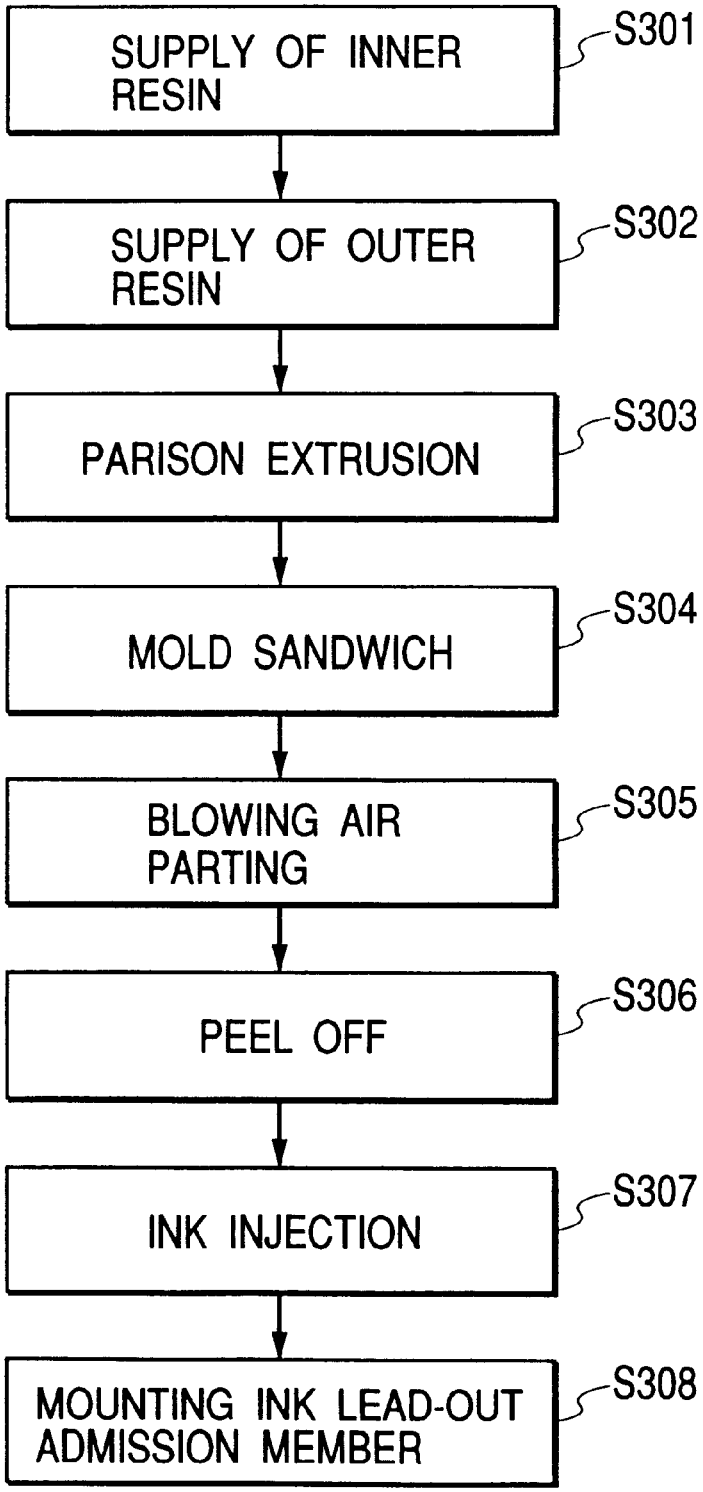
FIG. 5 is a flowchart which shows the manufacturing process of the ink tank in accordance with the present invention.

Now, the metal mold 208, which is arranged to sandwich the integrally formed parison 207, moves from the state shown in FIG. 4B to the state shown in FIG. 4C, thus sandwiching the parison 207 (step S304).

In continuation, as shown in FIG. 4C, the air is injected from the air nozzle 209 to execute the blow molding to form the shape which matches with the metal mold 208 (step S305). Here, FIGS. 6A1 and 6A2 illustrate the condition of the ink tank schematically in this case where the inner walls and outer walls are closely in contact without any gap. Also, it is more desirable to adjust the temperature of the mold within a range of ±30° C. against the standard temperature when molding. Then, it becomes possible to reduce the variation of individual difference in the thickness of each wall of the ink tank when manufactured.

Now, the inner and outer walls of the portions other than those of the ink supply unit are peeled off (parted) (step S306). FIGS. 6B1 and 6B2 are views which schematically illustrate the state of the ink tank in the step S306 where the peeling is executed by means of vacuum suction. As a method for peeling off the inner walls and outer walls by other means than the vacuum suction, there is the one in which materials having different thermal expansion coefficients (shrinkage factors) are used for the molding resins that form the inner walls and outer walls, respectively. In this case, it becomes possible to execute the intended peeling automatically when the temperature of the molded product is lowered after the blow molding, thus reducing the number of steps in the manufacturing process. Also, it is possible to peel off the inner walls and outer walls after molding by exerting external force upon the portion where the parison is sandwiched by the molds at the time of blow molding. Then, the gap thus formed is communicated with the air, and used as the communication port with the air outside. This method is more preferable because it can reduced the number of steps in manufacturing an ink container for ink jet use.

After the inner walls and outer walls are peeled off as described above, ink is injected (step S307). In this case, before ink is injected, the ink containing portion is made almost the same shape as in the initial state by use of compression air (FIGS. 6C1 and 6C2), and then, ink may be injected or it may be possible to inject ink under pressure when the ink containing portion is arranged to be in the shape as in the initial state.

Also, the amount of injected ink should be approximately 90% of the volume of the ink containing portion, and not more. However, ink is injected almost 100% in the gaps to enable the ink tank to easily cope with changes of the environment under which the ink tank is placed. Then, ink leakage to the outside can be prevented even when the external force is exercised, the temperature changes, or the atmospheric pressure changes.

FIGS. 6D1 and 6D2 are views which schematically illustrate the state of the ink tank after the completion of ink injection. In this state, the inner walls and outer walls of the ink tank are made separable when ink is led out. Then, after ink has been injected, the ink lead-out admission member is installed (step S308).

Through each of the steps described above, the ink tank of the present embodiment has been manufactured.

Figure 7A:
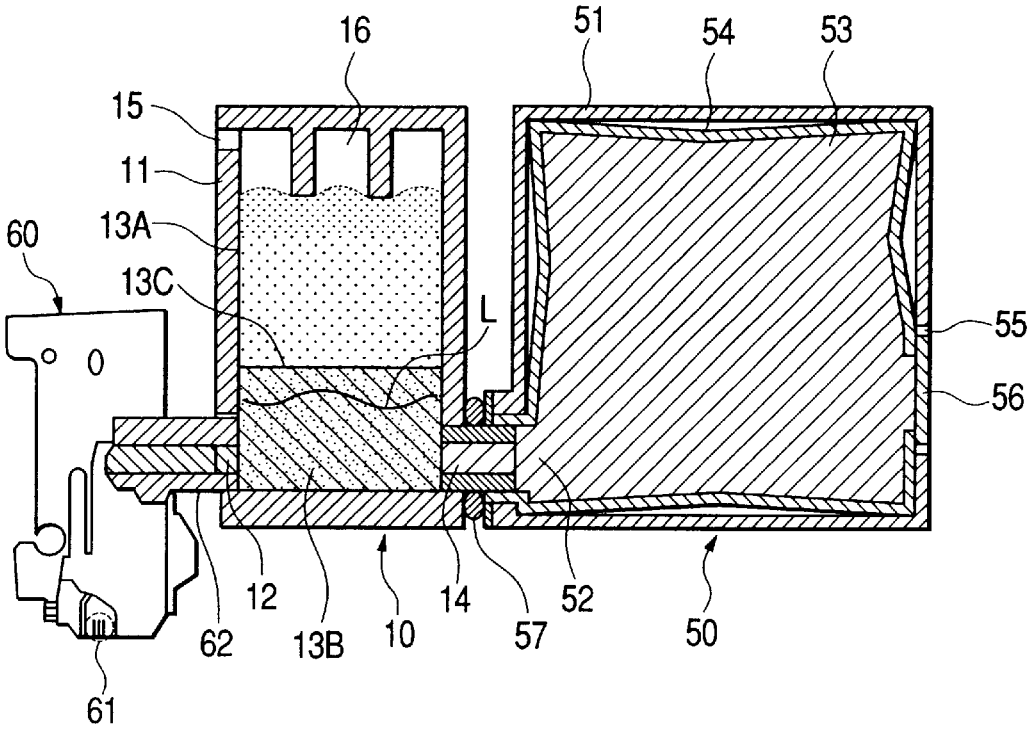
FIGS. 7A and 7B are cross-sectional views which schematically illustrate an ink tank in accordance with a third embodiment of the present invention.
Figure 7B:
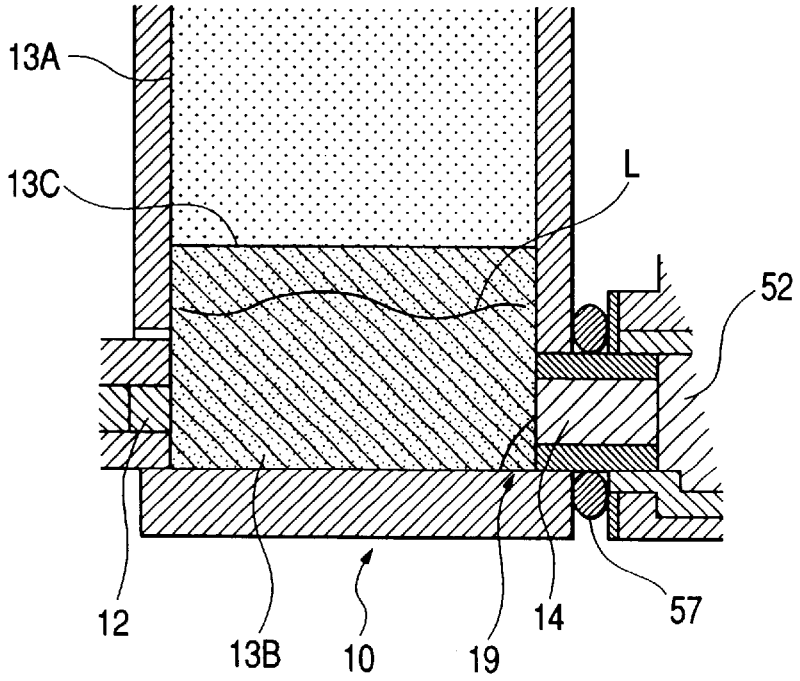

(Third Embodiment) FIGS. 7A and 7B are cross-sectional views which schematically illustrate an ink tank in accordance with a third embodiment of the present invention. FIG. 7A is a cross-sectional view which schematically shows the liquid supply system to which the ink tank of the third embodiment is applied in accordance with the present invention. FIG. 7B is a cross-sectional view which shows the principal part of the liquid supply system.

Hereinafter, the description will be made of the liquid supply system shown in FIGS. 7A and 7B by dividing it into the container for a capillary force generating member, and the liquid container.

(1) The Container for a Capillary Force Generating Member

For the present embodiment, the container 10 for the capillary force generating members is in contact with the capillary force generating member which is the negative pressure generating member, and at the same time, this member is provided with a communication tube (gas-liquid exchanging passage) 14 as a communication unit for inducing liquid from the liquid container. Also, the container 10 for the capillary force generating members is provided with the first capillary force generating member 13A and the second capillary force generating member 13B which is closely in contact with the first capillary force generating member. The interface 13C between them is installed as the communication unit above the upper end of the communication tube in the posture at the time of use.

With the capillary force generating member which is divided into plural members, the interface therebetween is installed as the air communication unit above the upper end of the communication tube 14 in the posture at the time of use. Thus, when ink resides both in the capillary force generating members 13A and 13B, it is possible to consume ink contained in the lower capillary force generating member 13B after ink contained in the upper capillary force generating member 13A. Also, if the gas-liquid interface makes changes due to the environmental changes, ink is filled in the second capillary force generating member 13B and in the vicinity of the interface 13C between two capillary force generating members in the beginning, and then, ink is made progress into the first capillary force generating member 13A. Therefore, it becomes possible to secure stably the buffer regions other than the buffer space 16 in the container 10 for the capillary force generating members in the fibrous orientation of the second capillary force generating member 13B. Further, with the second capillary force generating member 13B whose capillary force is made relatively stronger than that of the first capillary force generating member 13A, it becomes possible to reliably consume ink in the capillary force generating member 13A which is located above when ink is used as in the present embodiment.

Additionally, in the case of the present embodiment, the interface layers of the first capillary force generating member 13A and the second capillary force generating member 13B are in contact under pressure. As a result, the compression ratio is higher in the vicinity of the interface layers of the capillary force generating members 13A and 13B than in the other locations to make the capillary force stronger. In other words, given the capillary force generated by the first capillary force generating member 13A as P1, the capillary force generated by the second capillary force generating member 13B as P2, and the capillary force generated by the interface 13C between the capillary force generating members and in the regions closer to it (interface layer) as PS, the relationship among them is P1<P2<PS. With the provision of the interface layer having such strong capillary force, it becomes possible to demonstrate the aforesaid effect reliably even if the range of the capillary force of P1 and P2, the thinner or thicker concentration of which is taken into account, is overlapped with the fluctuation of the concentration of such force in each of the capillary force generating members, because there is available the capillary force on the interface, which can satisfy the condition which is described above.

Here, the description will be made of the method for forming the interface 13C for the present embodiment. In the case of the present embodiment, the olefine fibrous resin material (2 deniers) having the capillary force of P2=−110 mmAq. is used as the structural material of the second capillary force generating member 13B. The hardness thereof is 0.69 kgf/mm. Here, the hardness of the capillary force generating member is obtained by measuring the repulsive force of the capillary force generating member when it is pushed into the container 10 for the capillary force generating members by use of a pressing rod of 15 mm diameter, and then, by the inclination of the repulsive force against the amount of depression.

On the other hand, although the same olefine fibrous resin material as the one used for the second capillary force generating member 13B is used for the first capillary force generating member 13A as its structural material, the capillary force thereof is weaker by P2=−80 mmAq. than that of the second capillary force generating member 13B, while the fiber diameter of the fibrous material is thicker (6 deniers), and the robustness of the absorbent is made higher to 1.88 kgf/mm.

In this way, the capillary force generating members are combined so that the capillary force generating member 13B whose capillary force is weaker becomes harder than the capillary force generating member 13A. Then, with these members being in contact under pressure, the interface between the capillary force generating members 13A and 13B of the present embodiment makes it possible to provide the intensity of the capillary forces in condition of P1<P2<PS when the first capillary force generating member 13A is collapsed. Further, it becomes possible to make the difference between the P1 and PS greater than the difference between the P1 and P2 under any circumstances.

In this respect, it may be possible to form the gap 19 by making the lower end of the contact portions of the capillary force generating members with the communication tube apart from each other locally as sown in FIG. 7B.

(2) Liquid Container

The liquid container (ink tank) 50 of the present embodiment comprises the housing (outer walls) 51 that form the container, and the walls (inner walls) 54 having the inner faces which are equal to or analogous to the inner faces of the housing as in each of the above embodiments, and then, provided with the ink containing portion 53 that contains ink in it, and the ink lead-out port 52 which is connected with the gas-liquid exchanging passage 14 of the container for the capillary force generating members for leading out liquid in the liquid container 53 into the container for the capillary force generating members. For the present embodiment, an O ring or some other sealing member 57 is provided for the connecting portion between the ink lead-out port and the gas-liquid exchanging passage to prevent the ink leakage from and the induction of the air outside into the connecting portion. The inner walls 54 are flexible, and the ink containing portion 53 is made deformable following the leading out of ink contained in it. Also, the inner walls 54 are provided with the welding portion (pinch offs) 56. Then, the inner walls are supported by the welding portion to engage with the outer walls. Also, the atmospheric communication port 55 is provided for the outer walls to make it possible to induce the air outside into the gap between the inner walls and outer walls.

Here, the liquid container of the present embodiment is structured by the six planes that form a rectangular parallelepiped, to which a cylindrical ink lead-out port 52 is added as a curved surface. The maximum surface area of this rectangular parallelepiped is indirectly represented in FIGS. 7A and 7B. Then, the thickness of the inner walls 54 is smaller on the vertex portions (hereinafter referred to as the "caners" including the case where the vertex portions form a finely curved-surface shape) than each central portion of the planes that form the rectangular parallelepiped. The thickness is gradually made smaller from each of the central portions to each of the corners to present a convex shape on the inner side of the ink container 53. This direction is, in other words, the same as the direction of deformation of each plane, which produces an effect in promoting the deformation to be described later.

Also, since the caners of the inner walls are formed by three faces. As a result, the strength of the caners of the inner walls is made greater than that of the central portions. Also, in terms of the surface extension, the thickness of the corners is smaller than that of the central portions, thus allowing the each of the planes to move. Here, it is preferable to make the thickness of the portions that form each of the corners substantially equally, respectively.

Now, since FIGS. 7A and 7B are schematic views, the positional relations between the outer walls 51 and inner walls 52 of the ink container are represented as if these walls are apart from each other with a gap. In practice, however, the outer and inner walls may be made either separable or in contact with each other or may be structured to be arranged with a slight gap.

The liquid container 50 having the deformable ink containing portion in it may supply ink in the interior thereof to the container 10 for the capillary force generating members even without any induction of the air outside into the ink container in some cases. On the contrary, ink is not supplied to the capillary force generating member soon even when the air outside is inducted into the liquid container 50 along with the consumption of ink. Further, along with the induction of the air outside into the liquid container 50, ink in the liquid container 50 is supplied to the container 10 for the capillary force generating members immediately. These events depend on the dynamic and static balances of negative pressure between the ink containing portion 53 and the capillary force generating members 13A and 13B.

Now, hereunder, the description will be made of the specific examples of these motions. With the structures arranged in accordance with the present embodiment, the gas-liquid exchanging operation different from the structure of the conventional ink tank (which differs from the conventional gas-liquid exchange in terms of timing) may be performed in some cases. Due to the time lag between the ink lead-out from the ink containing portion 53 and the induction of the air into the ink containing portion 53 when the gas-liquid exchange is made, reliability is increased by the buffer effect or delayed timing in maintaining the stable ink supply even if ink is consumed rapidly, the environment is caused to change, or the external force, such as vibrations, is exerted.

Now, at first, the brief description will be made of the operation of ink consumption, beginning with the installation of the liquid container 50 on the container 10 for the capillary force generating members until ink in the container 50 is consumed as shown in FIG. 7A.

When the liquid container 50 is connected with the container 10 for the capillary force generating members, ink moves until the pressure becomes equal in the container 10 for the capillary force generating members and the liquid container 50, thus enabling them to be in the use initiation state. After that, when ink consumption begins by use of liquid discharge recording means (the recording head unit 60 provided with the discharge ports 61, the ink lead-out tube 62, and the like as shown in FIG. 7A), the ink, which is retained both in the ink containing portion 53 and the capillary force generating members 13A and 13B, is at first, consumed, while taking the balance in the direction in which the value of static pressure, which is generated both in the ink containing portion 53 and the capillary force generating members 13A and 13B, is caused to increase (the first state of ink supply: the A region in FIG. 8A).

Figure 8A:
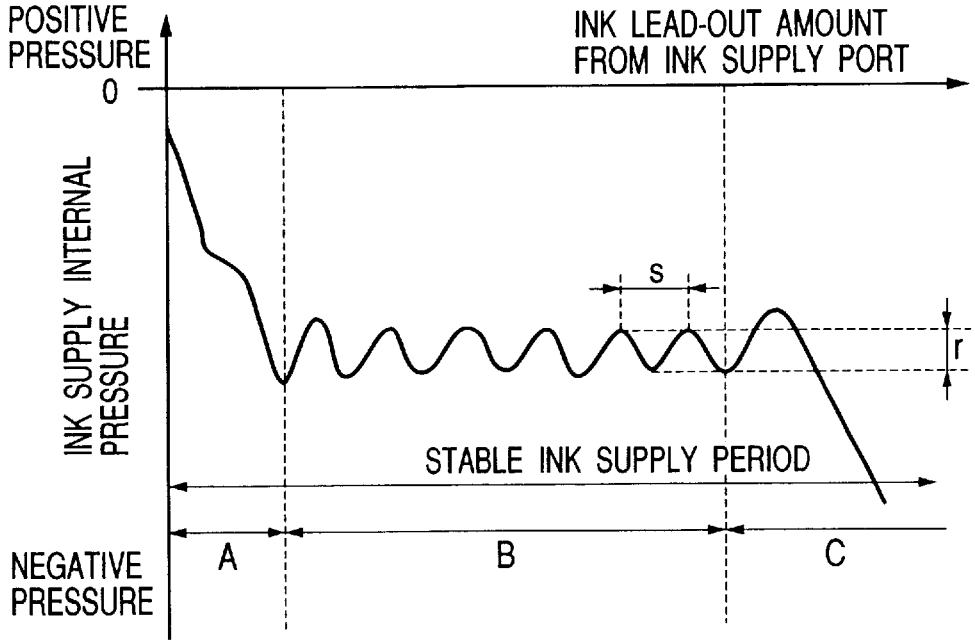
FIGS. 8A and 8B are graphs which illustrate the relationship between the amount of ink led out from the ink containing portion, the inner pressure on the ink supply, and the amount of the air induced into the ink containing portion.

Then, through the gas-liquid exchanging condition (the second ink supply state: The B region in FIG. 8A) where substantially a constant negative pressure is maintained against the ink lead-out while the capillary force generating members keep the gas-liquid interface by inducing the air outside into the ink containing portion 53, the remaining ink in the container 10 for the capillary force generating members is consumed (the C region in FIG. 8A). In this respect, FIG. 8A is a view which illustrates one example of the changing rate of negative pressure in the ink supply port 12 in this case. The axis of abscissa indicates the amount of ink led out from the ink supply port to the outside, and the axis of ordinate indicates negative pressure (static pressure in the ink supply port portion).

As described above, there is a process in which the ink tank of the present invention used ink in the ink containing portion 53 without inducing the air outside into the ink containing portion 53. Therefore, in this process of ink supply (the first ink supply condition), the inner capacity of the ink container 50 is restricted, and only the care should be taken as to the air induced into the ink containing portion 53 when the coupling is made. There is then an advantage that the ink tank can cope with the environmental changes even if the restriction imposed upon the inner capacity of the liquid container 50 is eased.

Also, even if the liquid containers 50 are exchanged in any one of the above regions A, B, and C, it is possible to generate negative pressure stably, and execute the ink supply operation reliably. In other words, by use of the ink tank of the present invention, not only ink in the liquid container 50 can be consumed almost completely, but also, the air may be contained in the gas-liquid exchanging passage 14 when the liquid containers are replaced. Now that the liquid containers 50 can be replaced irrespective of the amount of ink retained in the capillary force generating members 13A and 13B, it becomes possible to provide the ink supply system which makes the liquid containers 50 exchangeable without the provision of the ink remainders detection mechanism which is required for the conventional art.

Here, with reference to FIG. 8B, and also, from the different viewpoint, the description will be made of the series of operations in the process of the ink consumption as has been described above.

Figure 8B:
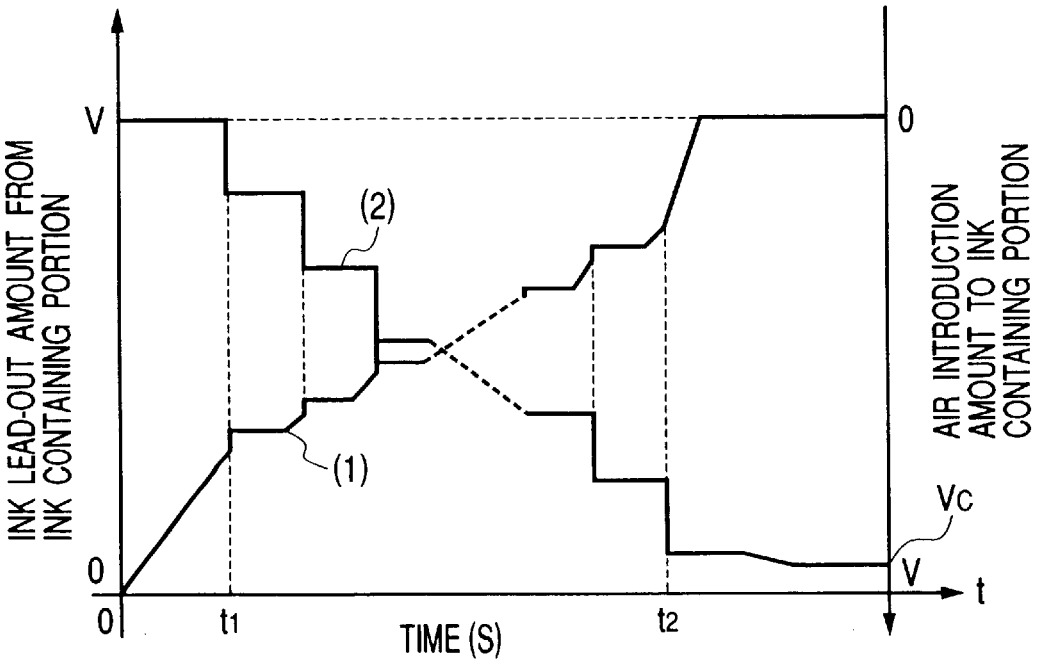

In FIG. 8B, the axis of abscissa indicates time, and the axis of ordinate indicates one example of the ink lead-out amount from the ink containing portion and the amount of air induced into the ink containing portion. Here, it is assumed that the amount of ink discharged from the ink jet recording head is constant in this time passage. The solid line (1) indicates the ink lead-out amount from the ink containing portion 53. The solid line (2) indicates the amount of air induced into the ink containing portion 53.

The region from the t=0 to t=t1 corresponds to the gas-liquid exchanging region in FIG. 8A. In this region, ink is discharged from the head, while, as described earlier, the balance is being taken between the leading out of ink from the capillary force generating members 13A and 13B, and that from the ink containing portion.

Then, the region from the t=t1 to t=t2 corresponds to the gas-liquid exchanging region (the region B) in FIG. 8A. In this region, the gas-liquid exchange is performed on the bases of a negative pressure balance. As indicated by the solid line (1) in FIG. 8B, ink is led out from the ink containing portion 53 when the air is induced into the ink containing portion 53 (as designated by the steps indicated by the solid line (2)). At this juncture, ink is not necessarily led out from the ink containing portion 53 immediately in an amount equal to the amount of the air as it is induced into the ink containing portion. Here, it is arranged that ink is led out in an amount equal to the amount of induced air ultimately after a specific period of time elapses since the induction of the air, for example. As clear from FIG. 8B, the gas-liquid exchange of the ink tank embodying the present invention has a time lag as compared with the conventional ink tank whose ink containing portion is not made deformable. Then, as described above, this operation is repeated in the gas-liquid exchanging region. At a certain point, the amount of the air and that of ink are inverted in the ink containing portion 53.

Subsequent to the t=t2, the operation arrives at the region after the gas-liquid exchange (the region C) shown in FIG. 8A. In this region, the pressure exerted in the ink containing portion 53 becomes substantially the same as the atmospheric pressure as described earlier. Along this, the container 50 operates to be restored to the initial state (the state prior to initiating use) by means of resiliency of the inner walls of the ink containing portion 53. However, the container cannot be restored to the initial state completely due to the so-called buckling. As a result, the ultimate amount of induced air Vc to the ink containing portion 53 becomes (V>Vc). Nevertheless, the status then is that ink in the ink containing portion 53 has been completely used.

As described above, the characteristic phenomenon of the gas-liquid exchanging operation in the structure that embodies the present invention is that the changes of pressure during the gas-liquid exchanges (that is, the amplitude r and the cycles s in FIG. 8A) are comparatively larger than that of the ink tank system that performs the conventional gas-liquid exchanges.

This is because the inner walls 54 is in a state of being deformed in the inner direction of the tank due to the ink lead-out from the ink containing portion 53 before the gas-liquid exchanges are executed. Then, by the resiliency of the inner walls 54, the externally orientated force is allowed to act always upon the inner walls 54 of the ink containing portion 53. As a result, the amount of air entering the ink containing portion 53, which eases the difference in pressure between the capillary force generating members 13A and 13B, and the ink containing portion 53 at the time of the gas-liquid exchanges, often becomes more than a predetermined amount as described earlier. Thus, ink tends to be lead out more from the ink containing portion 53 to the container 10 for the capillary force generating members. In contrast, the conventional system structured with the ink containing portion which is not deformable leads out ink immediately to the container for the capillary force generating members as soon as a specific amount of air enters the ink containing portion.

For example, if a printing is performed with 100% duty mode (the mode in which printing is made all over the printing surface), a large amount of ink is discharged from the head at a time. Then, ink is abruptly led out from the tank accordingly. In accordance with the ink tank of the present embodiment, however, ink is led out by means of the gas-liquid exchanges more often than the conventional system to make it possible to avoid ink shortage, thus enhancing reliability in this respect.

Also, in accordance with the structure of the present embodiment, ink is led out while the ink containing portion 53 is deformed in the inner direction with a further advantage that the buffer effect is made higher still against the external factors, such as vibrations of the carriage, the environmental changes, among some others.

As described above, the liquid supply system of the present embodiment can ease fine changes of negative pressure with the liquid containing portion 53 thus arranged. Further, in accordance with the structure of the present embodiment, it becomes possible to cope with the environmental changes by a solution which is different from the conventional one even when the air is contained in the ink containing portion 53, such as, in the state of the second ink supply.

Now, in conjunction with FIGS. 9A and 9B, the description will be made of the mechanism whereby to retain liquid stably for the ink tank shown in FIGS. 7A and 7B when the environmental condition is caused to change.

If the air in the ink containing portion 53 is caused to expand due to the reduction of the atmospheric pressure (or due to temperature rise), the wall faces that form the ink containing portion 53 and the liquid surface are compressed in accordance with the structure of the present embodiment. Thus, the inner volume of the ink containing portion 53 increases, and at the same time, ink is partly led out from the ink containing portion 53 to the container 10 for the capillary force generating members through the gas-liquid exchanging passage 14. Here, since the inner volume of the ink containing portion 53 increases, the amount of ink led out to the capillary force generating members 13A and 13B is considerably smaller than the case where an ink containing portion 53 is not made deformable.

Here, the amount of ink led out through the gas-liquid exchanging passage 14 is governed initially by the influence exerted by the resistive force of the wall faces which is generated by easing the deformation of the inner walls in the inner direction of the ink containing portion 53, and by the resistive force for absorbing ink by moving it to the capillary force generating members 13A and 13B, because the inner volume of the ink containing portion 53 is allowed to increase by easing negative pressure in the ink containing portion 53 when the atmospheric pressure changes abruptly.

Particularly, in the case of the present embodiment, the flow resistance in the capillary force generating members 13A and 13B is greater than the resistance against the restoration of the ink containing portion 53. Therefore, along with the air expansion, the inner volume of the ink containing portion 53 is allowed to increase at first. Then, if the voluminal increase due to the air expansion is greater than the upper limit set for the increased volume, ink is led out from the interior of the ink containing portion 53 to the container 10 for the capillary force generating members though the gas-liquid exchanging passage 14. In this manner, the wall faces of the ink containing portion 53 function as buffers against the environmental changes. Thus, the movement of ink in the capillary force generating members 13A and 13B is eased to make the characteristic of negative pressure stabilized in the ink supply port portion.

In this respect, it is arranged in accordance with the present embodiment that the ink which has been led out to the container 10 for the capillary force generating members is retained by the capillary force generating members 13A and 13B. In this case, the gas-liquid interface is raised due to the provisionally increased amount of ink in the container 10 for the capillary force generating members. Therefore, as in the initial state of use, the inner pressure is temporarily on the positive side slightly more than the stable period of the ink inner pressure. However, the influence that may be exerted on the discharge characteristics of liquid jet recording means of a recording head or the like is small, and there is no problem at all in practice. Also, when the atmospheric pressure is restored to the level before the reduction thereof (that is, returns to a pressure of 1 atmosphere) or (returns to the original temperature), the ink, which leaks to the container 10 for the capillary force generating members and retained by the capillary force generating members 13A and 13B, is allowed to return to the ink containing portion 53 again, and at the same time, the value of the ink containing portion 53 is restored to the original one.

Now, the description will be made of the principle of the operation when the normal condition is reached under the changed atmospheric pressure after the atmospheric pressure has changed subsequent to the operation in the initial stage.

The characteristic event in this state is that the interface of ink retained in the capillary force generating members 13A and 13B is allowed to change so as to keep balance not only with the amount of ink led out from the ink containing portion 53, but also, with the changes of negative pressure due to the voluminal changes of the ink containing portion 53 itself.

Here, in accordance with the present embodiment, the relationship between the amount of ink absorbed by the capillary force generating members 13A and 13B, and the liquid container 50 should only be determined by the maximum amount of ink absorption by the container 10 for the capillary force generating members in consideration of the amount of ink that may be led out from the liquid container 50 in the worst condition at the time of ink being supplied from the liquid container 50, as well as the amount of ink to be retained in the container 10 for the capillary force generating members from the viewpoint of the ink leakage prevention from the atmospheric communication port or the like when it is reduced or the temperature may change. Then, it should be good enough if only the volume is provided for the container 10 for the capillary force generating members so as to enable the capillary force generating member 13A and 13B to contain at lest such amount of ink to be absorbed.

Figure 9A:
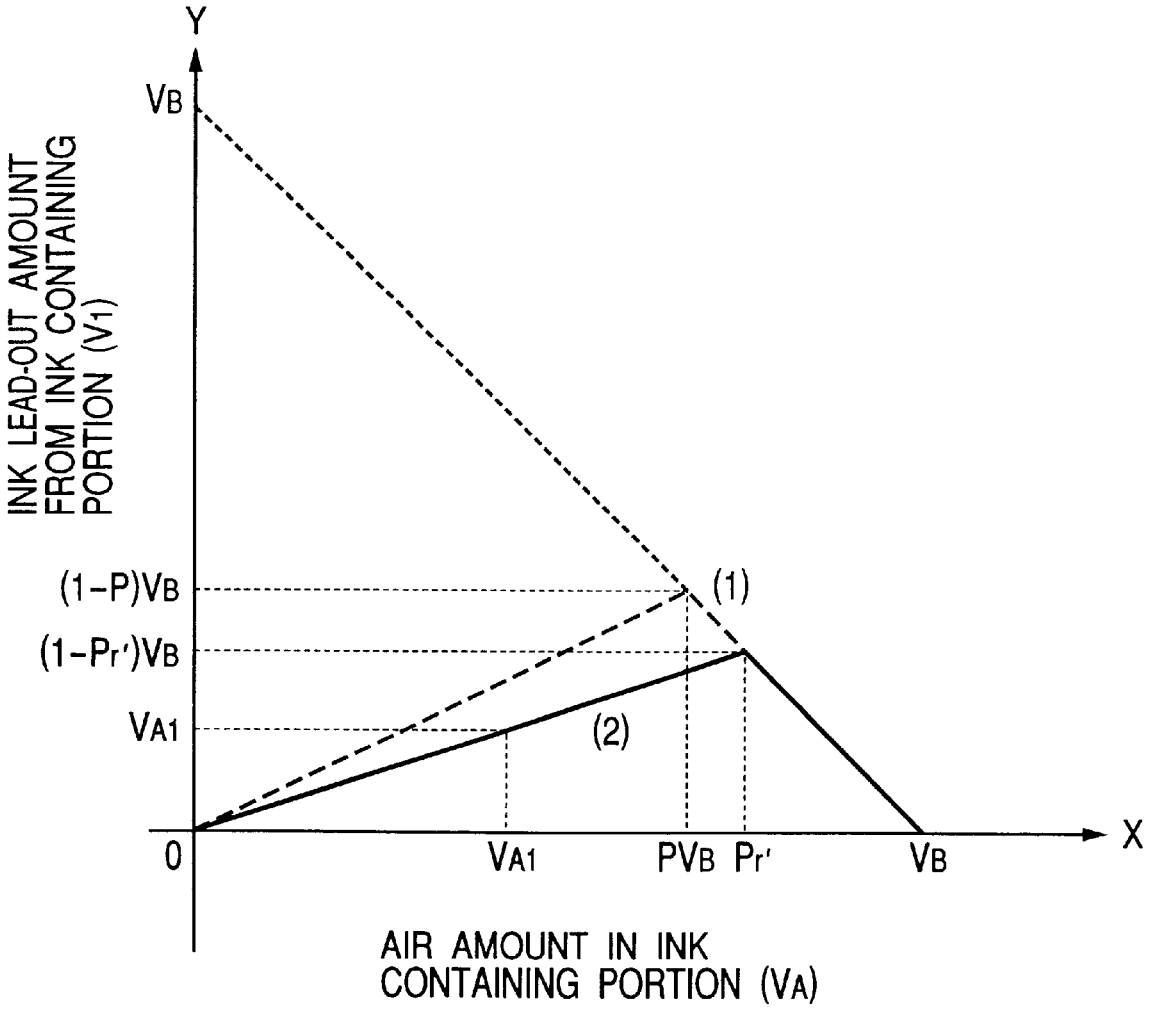
FIGS. 9A and 9B are graphs which illustrate the relationship between the amount of ink led out from the ink containing portion, the amount of inner air in the ink containing portion, and the volume of the ink containing portion.

FIG. 9A indicates the initial spacial volume (the volume of the air) before the reduction of pressure in the ink containing portion 53 on the axis of abscissa X when the ink containing portion 53 is not deformed at all by the expansion of the air, and indicates the amount of led-out ink on the axis of ordinate Y when the atmosphere is reduced to the atmosphere P ($0<P<1$). Then, these relationships are indicated by the dotted line (1).

Now, therefore, if the maximum reduction of the atmospheric pressure is conditioned to be 0.7 atmosphere, for example, when the worst condition of the amount of ink that may be led out from the in containing portion is estimated, such condition should take place only in the case where a 30% of ink of the volume VB of the ink containing portion still remain in it. Then, if the ink placed lower than the lower end of the ink chamber walls is assumed to be absorbed by the compressed absorbent in the capillary force generating members, it should be conceivable that all the ink that remains in the ink containing portion (the 30% of the VB) leaks out.

In contrast, in accordance with the present embodiment, the ink containing portion 53 is deformed as the air expands. As a result, the inner volume of the ink containing portion 53 increases after expansion from the inner volume of the ink containing portion 53 before expansion. At the same time, the ink retaining level in the container 10 for the capillary force generating members is allowed to change so as to keep balance with the changes of negative pressure due the deformation of the ink containing portion 53. Then, in the normal condition, negative pressure is in balance with the capillary force generating members 13A and 13B whose negative pressure has been reduced as compared with the one existing before the atmospheric pressure changes due to the ink which has been led out from the ink retaining portion 53. In other words, by the expanded amount of the ink containing portion 53, the amount of ink to be led out becomes smaller. As a result, as indicated by the solid line (2), the estimated amount of ink, which is led out from the ink containing portion 53 under the worst condition, is made smaller than the case where an ink containing portion 53 is not deformed at all against the air expansion as readily understandable from the representation by the dotted line (1) and the solid line (2). The aforesaid phenomenon is the same when the temperature of an ink tank changes. The lead-out amount is smaller than the case where the pressure is reduced as described above even if the temperature rises approximately by 50° C.

As has been described, in accordance with the ink tank of the present invention, the air expansion in the liquid container 50 due to the environmental changes is made allowable even in the liquid container 50 not only by the provision of the container 10 for the capillary force generating members, but also, by the buffer effect produced by increasing the volume of the liquid container 50 itself until the outer contour of the ink containing portion 53 becomes substantially equal to the shape of the inner faces of the housing at the maximum. Therefore, even if the amount of ink to be contained in the liquid container 50 is considerably increased, it is still possible to provide a liquid supply system which can cope with the environmental changes efficiently.

Figure 9B:
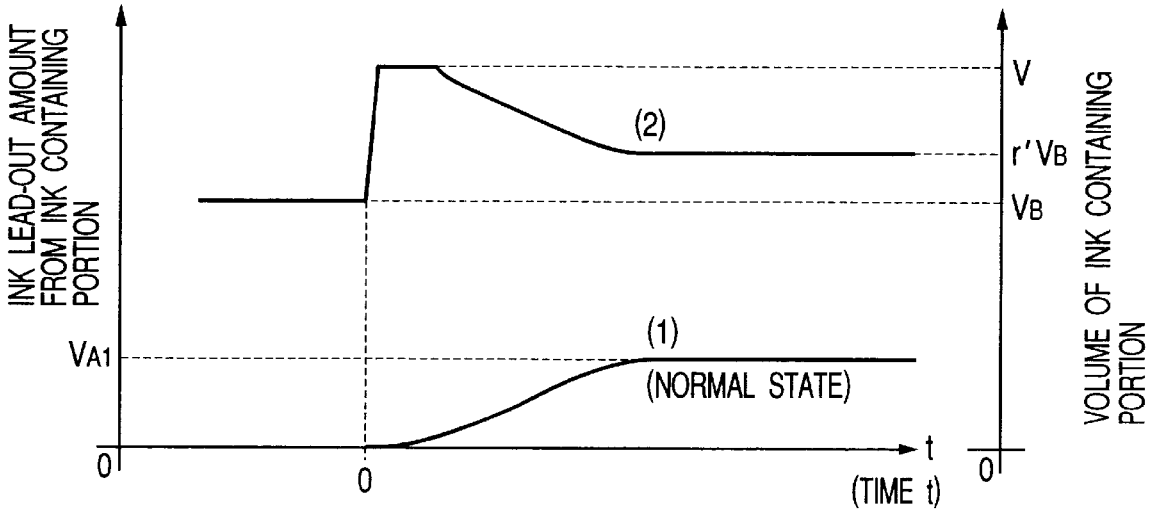

Also, FIG. 9B shows schematically the lead-out amount of ink from the ink containing portion, and the volumes of ink containing portion as the time elapses when the initial air volume is given as VA1 and the use environment of the tank is changed from the atmospheric condition to the reduced atmospheric environment, that is, the atmosphere P (0<P<1) at the t=0. In FIG. 9B, the axis of abscissa indicates time (t), and the axis of ordinate indicates the amount of ink led out from the ink containing portion, and the volumes of the ink containing portion. The solid line (1) indicates the temporal changes of the amount of ink led out from the ink containing portion, and the solid line (2) indicates the temporal changes of the volumes of the ink containing portion.

As shown in FIG. 9B, if the environment changes abruptly, the liquid container 50 can mainly cope with the air expansion before the normal condition of negative pressure balance is kept lastly by means of the container 10 for the capillary force generating members, and the liquid container 50. Therefore, it becomes possible to retard the leading out timing of ink from the liquid container 50 to the container 10 for the capillary force generating members when the environment changes abruptly.

Therefore, it becomes possible to provide the liquid supply system capable of supplying ink under a stable condition of negative pressure, while the allowance is being enhanced under various use environments against the expansion of the air outside which is induced by the gas-liquid exchanges when the liquid container 50 is in use.

In accordance with the liquid supply system of the present embodiment, it is possible to select materials arbitrarily for the capillary force generating members 13A and 13B and the ink containing portion 53. As a result, the voluminal ratio of the container 10 for the capillary force generating members and the ink containing portion 53 can be determined arbitrarily. Then, even when the voluminal ratios between them is larger than 1:2, it is practicably possible to use them. Particularly, if the buffer effect of the ink containing portion 53 should be given more importance, it is good enough if only the degree of the deformation should be made greater for the ink containing portion 53 in the gas-liquid exchanging condition in the initial state of use within a range where the elastic deformation is possible.

As described above, in accordance with the liquid supply system of the present embodiment, it becomes possible to demonstrate the multiplier effect against the changes of the external environment even when the capillary force generating member 13A and 13B should occupy a small volume depending on the way in which the container 10 for the capillary force generating members is structured.

Also, as has been described already, each of the ink tanks described in accordance with the first and second embodiments has a smaller elastic modulus, respectively, for the inner walls thereof due to the change of the environmental temperatures. Therefore, if any one of these ink tanks is adopted for the ink supply system of the present embodiment, it becomes possible to stabilize the characteristic of negative pressure in good condition. Thus, if the ink tank described in each of the first and second embodiments is applied to the liquid supply system of the present embodiment, it becomes possible to reduce the buffer space of the container 10 for the capillary force generating member still more.

As has been described above, by use of the liquid container of the present invention, the characteristic of negative pressure is stabilized irrespective of the temperature changes of use environment, hence making it possible to implement the liquid supply stably.

Also, even if the structure is formed mainly by the olefine material whose glass transition temperature is low in particular, it is possible to enhance the recycling capability of the product, while maintaining the function of a resistive layer against the environmental temperature changes, if an amorphous polyolefine is used.

What is claimed is:

1. A liquid container comprising:

an inner wall for forming a liquid containing portion to contain liquid therein;

an outer wall for forming a container to contain said liquid containing portion therein; and a liquid supply portion for supplying liquid from said liquid containing portion to an outside thereof, wherein said inner wall includes a deformable member to generate negative pressure in said liquid containing portion by being deformed following the supply of liquid, and wherein said inner wall is formed by an amorphous resin material having a higher glass transition temperature than a maximum temperature of a use environment of said liquid container.

2. A liquid container according to claim 1, wherein said liquid container is installed on a container for a negative pressure generating member constructed to generate a gas-liquid exchange for leading out liquid by inducing gas into said liquid containing portion through said liquid supply portion.

3. A liquid container comprising:

an inner wall for forming a liquid containing portion to contain liquid therein;

an outer wall for forming a container to contain said liquid containing portion therein; and a liquid supply portion for supplying liquid from said liquid containing portion to an outside thereof, wherein said inner wall includes a deformable member to generate a negative pressure by being deformed following the supply of liquid, and wherein said inner wall is formed with a multiply layered structure comprising an oxygen-proof permeable layer, an insulative layer against an environmental temperature change, and a liquid resistance layer, and said liquid resistance layer is provided for an innermost layer to be in contact with the liquid, and said insulative layer is formed by an amorphous resin having a higher glass transition temperature than a maximum temperature of a use environment of said liquid container.

4. A liquid container according to claim 3, wherein said insulative layer of said inner wall is provided between said liquid resistance layer and said oxygen-proof permeable layer, and contains a functional bonding resin material.

5. A liquid container according to claim 3, wherein said oxygen-proof permeable layer of said inner wall is provided between said liquid resistance layer and said insulative layer, and contains a functional bonding resin material.

6. A liquid container according to claim 3, wherein said insulative layer of the inner wall is formed to provide an elastic modulus of 15% change or less following the temperature change of the use environment.

7. A liquid container according to claim 3, wherein said outer wall and all the layers of said inner wall are formed by a material containing ethylene or propylene as a skeletal structure thereof.

8. A liquid container according to claim 3, wherein said insulative layer is formed chiefly by an amorphous polyolefine material.

9. A liquid container according to claim 3, wherein said liquid container is installed on a container for a negative pressure generating member constructed to generate a gas-liquid exchange for leading out liquid by inducing gas into said liquid containing portion through said liquid supply portion.

10. A liquid container comprising: an inner wall for forming a liquid containing portion to contain liquid therein;

an outer wall for forming a container to contain said liquid containing portion therein; and a liquid supply portion for supplying liquid from said liquid containing portion to an outside thereof, wherein said inner wall includes a deformable member to generate negative pressure in said liquid containing portion by being deformed following the supply of liquid, and wherein said inner wall is formed by a material having an elastic modulus change of 25% or less against a temperature change of a use environment of said liquid container.

11. A liquid container according to claim 10, wherein said liquid container is installed on a container for a negative pressure generating member constructed to generate a gas-liquid exchange for leading out liquid by inducing gas into said liquid containing portion through said liquid supply portion.

12. A liquid supply system comprising:

a liquid container according to any one of claims 1–11; and a container for a negative pressure generating member, said container constructed to generate gas-liquid exchange for leading out liquid by inducing gas into said liquid containing portion through said liquid supply portion of said liquid container.

13. A liquid supply system according to claim 3, wherein said liquid container is structured to be attachable to and detachable from said container for the negative pressure generating member.

14. A method for manufacturing a liquid container provided with an inner wall for forming a liquid containing portion to contain liquid therein, an outer wall for forming a container to contain said liquid containing portion therein, and a liquid supply portion for supplying liquid from said liquid containing portion to an outside thereof, said method comprising the following steps of:

preparing a mold corresponding to an outer contour of said liquid container, a substantially cylindrical first parison having a diameter smaller than that of said mold for use of the outer wall, and a second parison for use of the inner wall; and forming said outer wall and inner wall of said liquid container by injecting air to expand said first and second parisons to follow said mold so as to make an area formed by said inner wall and an area formed by said outer wall separable and substantially analogous, wherein said step of preparing said second parison for use of said inner wall comprises a step of preparing a multiply layered parison having an oxygen-proof permeable layer, an insulative layer against an environmental temperature change, and a liquid resistance layer.

15. A method for manufacturing a liquid container according to claim 14, said step of preparing said second parison for use of the inner wall further comprising the steps of:

preparing said second parison to enable said insulative layer to be placed between said liquid resistance layer and said oxygen-proof permeable layer; and containing a functional bonding resin material in resin for forming said insulative layer.

16. A method for manufacturing a liquid container according to claim 14, said step of preparing said second parison further comprising the following steps of:

preparing said second parison to enable said oxygen-proof permeable layer to be placed between said liquid resistance layer and said insulative layer; and containing a functional bonding resin material in resin for forming said oxygen-proof permeable layer.

* * * * *

UNITED STATES PATENT AND TRADEMARK OFFICE

CERTIFICATE OF CORRECTION

PATENT NO. : 6,347,865 B1 
DATED : February 19, 2002
INVENTOR(S) : Hidehisa Matsumoto et al.

It is certified that error appears in the above-identified patent and that said Letters Patent is hereby corrected as shown below:

Column 5,
Line 36, "Is" should read -- is --.

Column 7,
Line 8, "curbed" should read -- curved --.

Column 10,
Line 61, "polyethylene" should read -- polyethylene) --.

Column 11,
Line 5, "a" should be deleted; and
Line 62, "walls" should read -- wall --.

Column 12,
Line 24, "inventor" should read -- inventors --.

Column 14,
Line 63, "reduced" should read -- reduce --.

Column 15,
Line 22, "(Third Embodiment) FIGS. 7A should read
-- (Third Embodiment) ¶ FIGS. 7A --.

Column 17,
Line 46, "the" (second occurrence) should be deleted.

Column 25,
Line 36, "claim 3," should read -- claim 12, --.

Signed and Sealed this

Third Day of September, 2002

*Attest:*

*Attesting Officer*

JAMES E. ROGAN
*Director of the United States Patent and Trademark Office*